US008275298B2

(12) United States Patent
Maeda et al.

(10) Patent No.: US 8,275,298 B2
(45) Date of Patent: Sep. 25, 2012

(54) DEVELOPER SUPPLY DEVICE

(75) Inventors: Masataka Maeda, Aichi (JP); Mitsukiyo Okamura, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 363 days.

(21) Appl. No.: 12/726,365

(22) Filed: Mar. 18, 2010

(65) Prior Publication Data

US 2010/0303511 A1 Dec. 2, 2010

(30) Foreign Application Priority Data

Jun. 1, 2009 (JP) ..... 2009-132027
Oct. 30, 2009 (JP) ..... 2009-250267

(51) Int. Cl.
*G03G 15/08* (2006.01)

(52) U.S. Cl. ..... 399/281; 399/289

(58) Field of Classification Search ..... 399/265, 399/279, 281, 286, 289
See application file for complete search history.

(56) References Cited

U.S. PATENT DOCUMENTS

| | | | | |
|---|---|---|---|---|
| 5,027,157 | A | 6/1991 | Hotomi et al. | |
| 5,761,591 | A * | 6/1998 | Yamaguchi | 399/289 |
| 6,708,014 | B2 * | 3/2004 | Miyaguchi et al. | 399/289 X |
| 6,901,232 | B2 * | 5/2005 | Sakuma et al. | 399/289 X |
| 7,099,611 | B2 | 8/2006 | Aoki et al. | |
| 7,236,720 | B2 * | 6/2007 | Nakazato et al. | 399/111 |
| 2004/0223792 | A1 | 11/2004 | Aoki et al. | |
| 2009/0175662 | A1 | 7/2009 | Nishiwaki | |

FOREIGN PATENT DOCUMENTS

| | | | |
|---|---|---|---|
| JP | 61-105574 | A | 5/1986 |
| JP | 02-160266 | A | 6/1990 |
| JP | 05-094084 | A | 4/1993 |
| JP | 2001-122436 | A | 5/2001 |
| JP | 2001-139144 | A | 5/2001 |
| JP | 2002-287484 | A | 10/2002 |
| JP | 2004-279880 | | 10/2004 |
| JP | 2004-280068 | A | 10/2004 |
| JP | 2004-341311 | A | 12/2004 |
| JP | 2008-070803 | | 3/2008 |
| JP | 2009-003212 | A | 1/2009 |
| JP | 2009-080299 | A | 4/2009 |

OTHER PUBLICATIONS

JP Notice of Allowance dated Mar. 21, 2012, corresponding Application No. 2009-250267.
JP Office Action dtd Aug. 16, 2011, JP Application No. 2009-250267; English Translation.

* cited by examiner

*Primary Examiner* — Sandra Brase
(74) *Attorney, Agent, or Firm* — Banner & Witcoff, Ltd.

(57) ABSTRACT

A developer supply device, comprising: a developer holding body having a circumferential surface and a rotation axis extending in a main scanning direction and being placed to face a supply target at a developer supply position; a carrying substrate that has a plurality of electrodes arranged along a direction intersecting with the main scanning direction and that carries a developer in a developer transport direction through a traveling electric field generated by application of a multiphase alternating voltage to the plurality of electrodes, the carrying substrate being located such that an end of the carrying substrate in the developer transport direction is positioned to face the developer holding body; and a voltage application unit configured to apply, to the plurality of electrodes and the developer holding body, the multiphase alternating voltage having alternating components synchronizing with each other.

17 Claims, 18 Drawing Sheets z

DEVELOPER SUPPLY DEVICE

CROSS-REFERENCE TO RELATED APPLICATION

This application claims priority under 35 U.S.C. §119 from Japanese Patent Applications No. 2009-132027, filed on Jun. 1, 2009 and No. 2009-250267, filed on Oct. 30, 2009. The entire subject matter of the applications is incorporated herein by reference.

BACKGROUND

1. Technical Field

Aspects of the present invention relate to a developer supply device configured to supply a developer to a supply target.

2. Related Art

Developer supply devices having a development roller, an upstream carrying unit and a downstream carrying unit have been proposed. In such a developer supply device, the upstream carrying unit generates a traveling electric field for carrying the developer on a carrying surface of the upstream carrying unit, and the downstream carrying unit generates a traveling electric field for carrying the developer on a carrying surface of the downstream carrying unit. The development roller is located to face a photosensitive drum (i.e., the supply target) to supply the developer carried from the upstream carrying unit to the photosensitive drum. When the developer not supplied to the photosensitive drum reaches the carrying surface of the downstream carrying unit, the developer is collected and carried by the downstream carrying unit.

SUMMARY

However, if the developer is not smoothly held on the development roller or the developer is not smoothly collected by the downstream carrying unit, the quality of a formed image deteriorates.

Aspects of the present invention are advantageous in that a developer supply device configured such that a developer can be smoothly held on a developer holding surface and/or the developer can be smoothly collected from the developer holding surface is provided.

According to an aspect of the invention, there is provided a developer supply device, comprising: a developer holding body having a cylindrical circumferential surface and a rotation axis extending in a main scanning direction so that the developer holding body is rotated about the rotation axis, the developer holding body being placed to face a supply target at a developer supply position; a carrying substrate that has a plurality of electrodes arranged along a direction intersecting with the main scanning direction and that carries a developer in a developer transport direction through a traveling electric field generated by application of a multiphase alternating voltage to the plurality of electrodes, the carrying substrate being located such that an end of the carrying substrate in the developer transport direction is positioned to face the developer holding body; and a voltage application unit configured to apply, to the plurality of electrodes and the developer holding body, the multiphase alternating voltage having alternating components synchronizing with each other.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
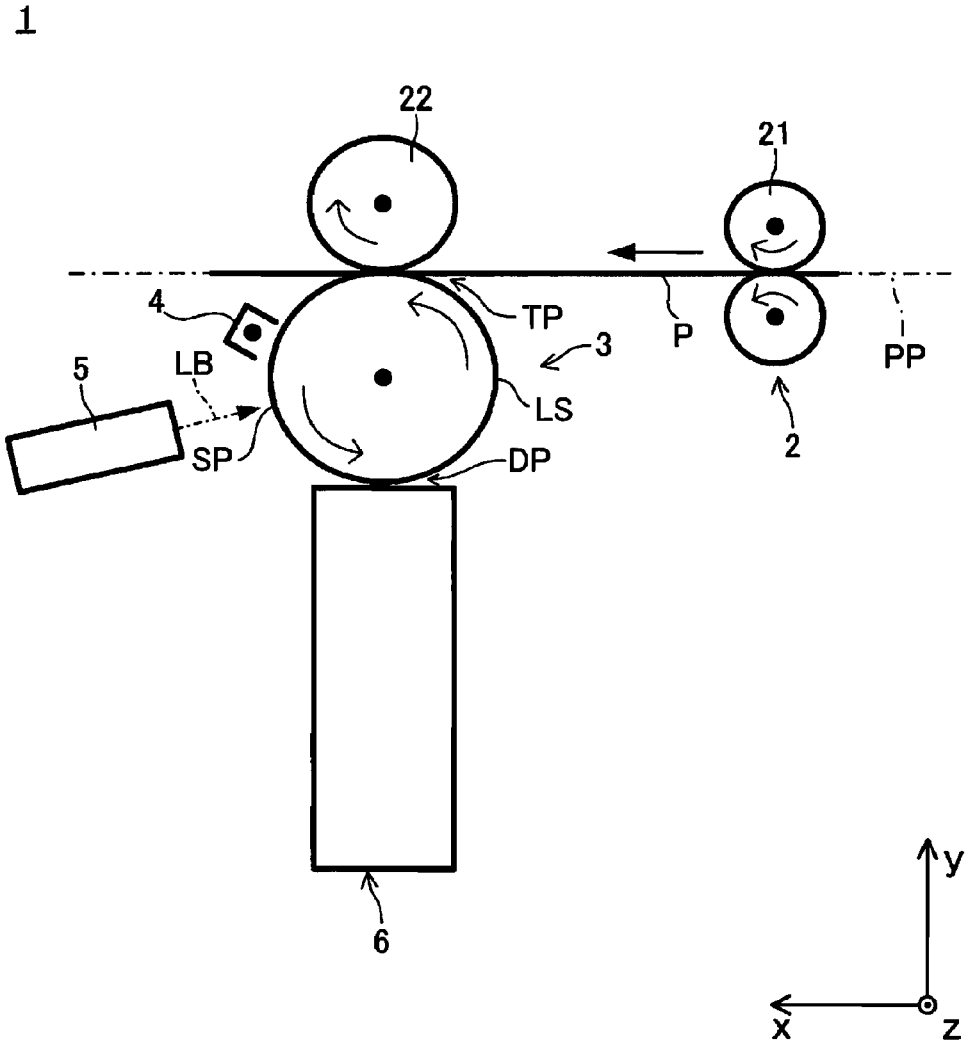
FIG. 1 is a side view illustrating a general configuration of a laser printer according to a first embodiment.

As shown in FIG. 1, a laser printer 1 according to a first embodiment includes a paper carrying mechanism 2, a photosensitive drum 3, a charger 4, a scanning unit 5 and a toner supply unit 6. On a paper supply tray (not shown) provided in the laser printer 1, a stack of sheets of paper is accommodated. The paper carrying mechanism 2 is configured to carry a sheet of paper P along a paper carrying path PP. An outer circumferential surface of the photosensitive drum 3 which is a supply target is formed to be an electrostatic latent image holding surface LS. The electrostatic latent image holding surface LS is formed as a cylindrical surface elongated in parallel with a main scanning direction (i.e., a direction of z-axis in FIG. 1). On the electrostatic latent image holding surface LS, an electrostatic latent image is formed as potential distribution, and toner T (developer) is held at portions corresponding to the electrostatic latent image.

The photosensitive drum 3 is configured to rotate in a direction indicated by an arrow in FIG. 1 (i.e., in the counterclockwise direction) about the center axis extending in parallel with the main scanning direction. That is, the photosensitive drum 3 is configured such that the electrostatic latent image holding surface LS moves along an auxiliary scanning direction which is perpendicular to the main scanning direction.

The charger 4 is located to face the electrostatic latent image holding surface LS. The charger 4 is a corotron type charger or a scorotron charger, and is configured to charge uniformly the electrostatic latent image holding surface LS.

The scanning unit 5 is configured to emit a laser beam LB modulated based on image data. That is, the scanning unit 5 emits the laser beam LB which is on/off modulated in accordance with presence/absence of pixel data and which has a predetermined wavelength band. Further, the scanning unit 5 is configured to converge the laser beam LB at a scan position SP on the electrostatic latent image holding surface LS. The scan position SP is located on the downstream side in the rotational direction of the photosensitive drum 3 with respect to the charger 4.

Further, the scanning unit 5 is configured to scan the laser beam LB, at the converged position, on the electrostatic latent image holding surface LS in the main scanning direction at a constant speed, so that an electrostatic latent image is formed on the electrostatic latent image holding surface LS.

The toner supply unit 6 is located under the photosensitive drum 3 to face the photosensitive drum 3. The toner supply unit 6 is configured to supply the toner T, which is in a charged state, to the electrostatic latent image holding surface LS at a development position DP (a developer supply position). The development position DP is a position at which the toner supply unit 6 faces the electrostatic latent image holding surface LS. The detailed configuration of the toner supply unit 6 is explained later.

Hereafter, each of the components of the laser printer 1 is explained in detail.

The paper carrying mechanism 2 includes a pair of registration rollers 21 and a transfer roller 22. The registration roller 21 is configured to send the sheet of paper P at predetermined timing toward a position between the transfer roller 22 and the photosensitive drum 3.

The transfer roller 22 is located such that the sheet of paper P is sandwiched at a transfer position TP between the transfer roller 22 and the photosensitive drum 3. Further, the transfer roller 22 is configured to be rotated in the direction indicated by an arrow in FIG. 1 (i.e., in the clockwise direction).

The transfer roller 22 is connected to a bias power source (not shown) so that a predetermined transfer voltage for transferring the toner adhered on the electrostatic latent image holding surface LS to the sheet of paper P is applied thereto.

Figure 2:
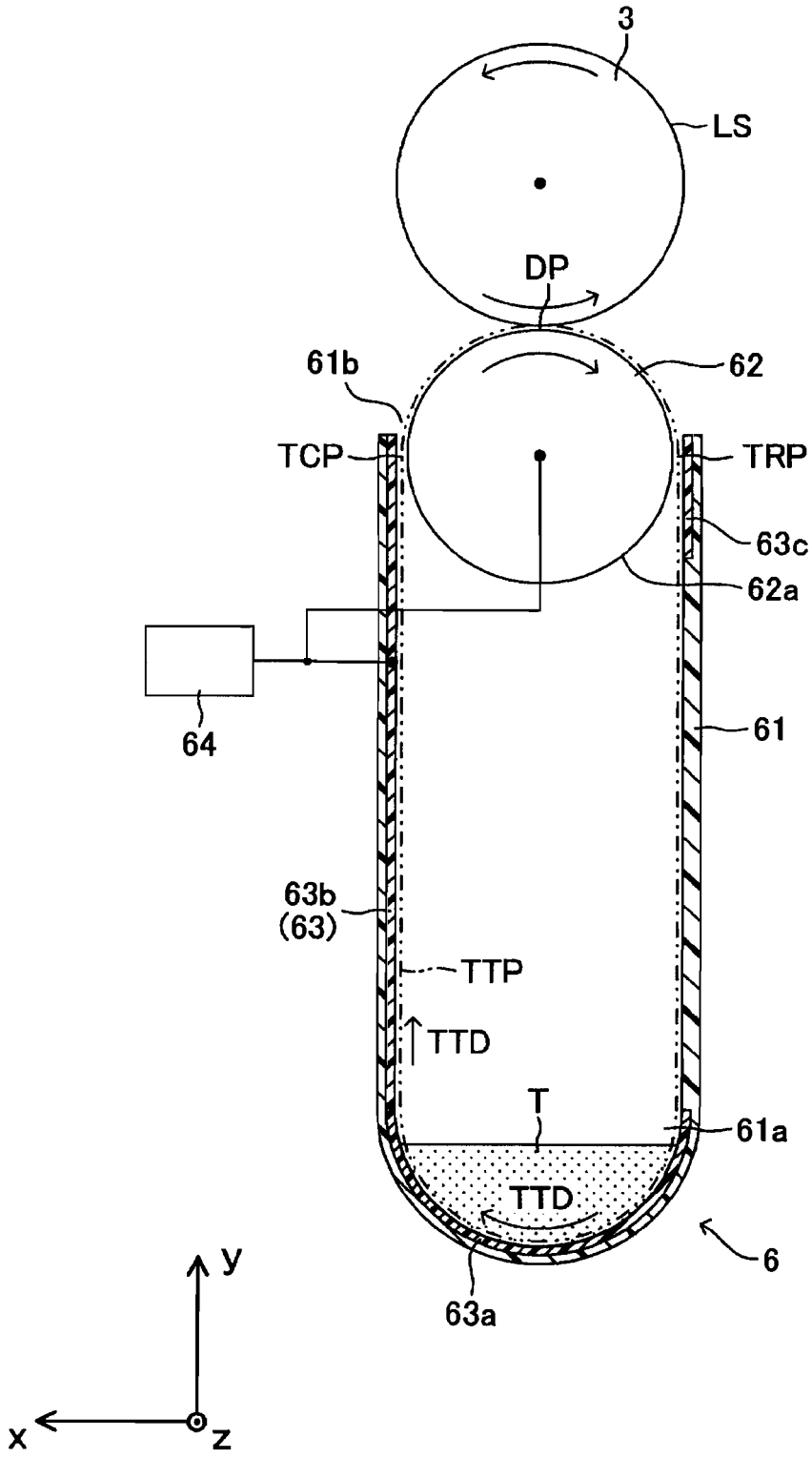
FIG. 2 is a side cross section illustrating a configuration of a toner supply unit shown in FIG. 1.

As shown in FIG. 2, the toner supply unit 6 is configured to supply the charged toner T to the photosensitive drum 3 by carrying the charged toner T through an electric field along a toner transport path TTP.

A toner box 61 serving as a casing of the toner supply unit 6 is a box type member having an elliptical shape when viewed as a side cross section, and is positioned such that the longer side thereof is in parallel with the vertical direction (i.e., the direction of y-axis). Inside the toner box 61, the toner T which is dry type powdery developer is accommodated. That is, a toner reservoir part 61*a* is formed by semicylindrical inside space formed at the lower end portion of the toner box 61. In this embodiment, the toner T has a positive electrostatic property, and is single component black toner having a nonmagnetic property.

At the top of the toner box 61 (i.e., the position facing the photosensitive drum 3), an opening 61*b* is formed. The opening 61*b* is formed so that the toner box 61 is opened upward toward the photosensitive drum 3. In this embodiment, the opening 61*b* is formed throughout the length of the inner space of the toner box 61 in a depth direction (i.e., in the main scanning direction).

Inside the toner box 61, a development roller 62 serving as a developer holding body is accommodated. The development roller 62 is a roller-like member having a toner holding surface 62*a* which is a cylindrical circumferential surface. The development roller 62 is located to face the photosensitive drum 3 through the opening 61*b*. That is, the toner box 61 and the development roller 62 are located so that, at the development position DP, the toner holding surface 62*a* of the development roller 62 is located closely to the electrostatic latent image holding surface LS of the photosensitive drum 3 via a gap having a predetermined interval (e.g., approximately 500 μm).

The development roller 62 is held at the upper end portion of the toner box 61 where the opening 61*b* is formed so that the development roller 62 is rotatable about an axis extending in the main scanning direction. In this embodiment, the development roller 62 is accommodated in the toner box 61 such that the rotation center axis of the development roller 62 is inside the toner box 61 and an approximately half of the toner holding surface 62*a* is exposed to the outside of the toner box 61.

Inside the toner box 61, a carrying substrate 63 is provided along the toner transport path TTP. The carrying substrate 63 is fixed on the inner wall of the toner box 61. In this embodiment, the carrying substrate 63 includes a bottom carrying substrate 63*a*, a supply substrate 63*b* and a collecting substrate 63*c*. The inner configuration of the carrying substrate 63 is explained in detail later.

The bottom carrying substrate 63*a* is located at the bottom in the inner space of the toner box 61 to form the bottom surface of the toner reservoir part 61*a*. The bottom carrying substrate 63*a* is formed as a recessed curved surface which is curved to have a semicylindrical shape when viewed as a side cross section. Further, the bottom carrying substrate 63*a* is formed to smoothly connect to the lower end of the supply substrate 63*b*. The bottom carrying substrate 63*a* is connected to the lower end of the supply substrate 63*b* so that the toner T in the toner reservoir part 61*a* is carried to the lower end of the supply substrate 63*b*.

The supply substrate 63*b* which is a plate-like member is formed to stand in the vertical direction so that the toner T is carried upward in the vertical direction from the lower end portion thereof connected to the bottom carrying substrate 63*a*.

In this embodiment, the upper end (i.e., an downstream end in the toner transport direction TTD) of the supply substrate 63*b* is located at substantially the same height as that of the center of the development roller 62 (see FIG. 2). In this embodiment, the upper end of the supply substrate 63*b* is located slightly higher than the center of the development roller 62. The upper end of the supply substrate 63*b* faces the toner holding surface 62*a* of the development roller 62.

The upper end of the supply substrate 63*b* and the toner holding surface 62*a* face with each other, via a predetermined gap (e.g., approximately 300 μm) at a toner catching position TCP which is on the upstream side of the development position DP in the moving direction of the toner holding surface 62*a* of the development roller 62. That is, the upper end of the supply substrate 63*b* is closest to the toner holding surface 62*a* at the toner catching position TCP.

The supply substrate 63*b* is configured to carry the toner T which has been received from the bottom carrying substrate 63*a*, to the toner catching position TCP in the toner transport direction TTD.

The collecting substrate 63*c* is located to face the development roller 62 at the opposite position with respect to the upper end of the supply substrate 63*b* while sandwiching the development roller 62 between the collecting substrate 63*c* and the upper end of the supply substrate 63*b*. That is, the collecting substrate 63*c* is located on the downstream side in the toner transport direction TTD with respect to the opening 61*b* of the toner box 61. In this embodiment, the end part of the collecting substrate 63*c* in the toner transport direction TTD is located at the position corresponding to the position of the lower end of the development roller 62.

In this embodiment, the upper end (i.e., an upstream side end in the toner transport direction TTD) of the collecting substrate 63*c* is position at substantially the same height as that of the center of the development roller 62 (see FIG. 2). In this embodiment, the upper end of the collecting substrate 63*c* is located slightly higher than the center of the development roller 62. The upper end of the collecting substrate 63*c* faces the toner holding surface 62*a* of the development roller 62.

The upper end of the collecting substrate 63*c* and the toner holding surface 62*a* face with each other, via a predetermined gap (e.g., approximately 300 μm) at a toner recovering position TRP which is on the downstream side of the development position DP in the moving direction of the toner holding surface 62*a* of the development roller 62. That is, the upper end of the collecting substrate 63*c* is closest to the toner holding surface 62*a* at the toner recovering position TRP.

The collecting substrate 63*c* collects, from the development roller 62, the toner T which has not been consumed at the development position DP, and carries downward the collected toner T toward the toner reservoir part 61*a*.

The carrying substrate 63 and the development roller 62 are electrically connected to a power supply circuit 64. The power supply circuit 64 outputs a voltage for circulating the toner T along the toner transport path TTP in the toner transport direction TTD (i.e., for carrying the toner T stored in the toner reservoir part 61*a* to the development roller 62 to supply the toner held on the development roller 62 to the development position DP, and for collecting, from the development roller 62, the toner T which has not been consumed at the development position DP to circulate the collected toner to the toner reservoir part 61*a*).

More specifically, the power supply circuit 64 outputs an alternating voltage having a rectangular waveform of +300V/0V, 300 Hz. In this embodiment, the frequency of the output voltage of the power supply circuit 64 is defined such that the carrying speed of the toner T in the toner transport direction TTD is equal to the moving speed of the toner holding surface 62*a* by rotation of the development roller 62.

More specifically, the power supply circuit 64 (serving as a voltage application unit) is configured to apply a multiphase alternating voltage to a plurality of carrying electrodes 631 provided on the carrying substrate 63, and to apply, to the development roller 62, a voltage which is in synchronization with the multiphase alternating voltage applied to the carrying electrodes 631. In this embodiment, the voltage applied to the development roller 62 has the same potential as that of a part of the carrying electrodes 631. Details concerning the voltage application from the power supply circuit 64 to the carrying substrate 63 and the development roller 62 are explained later.

Figure 3:
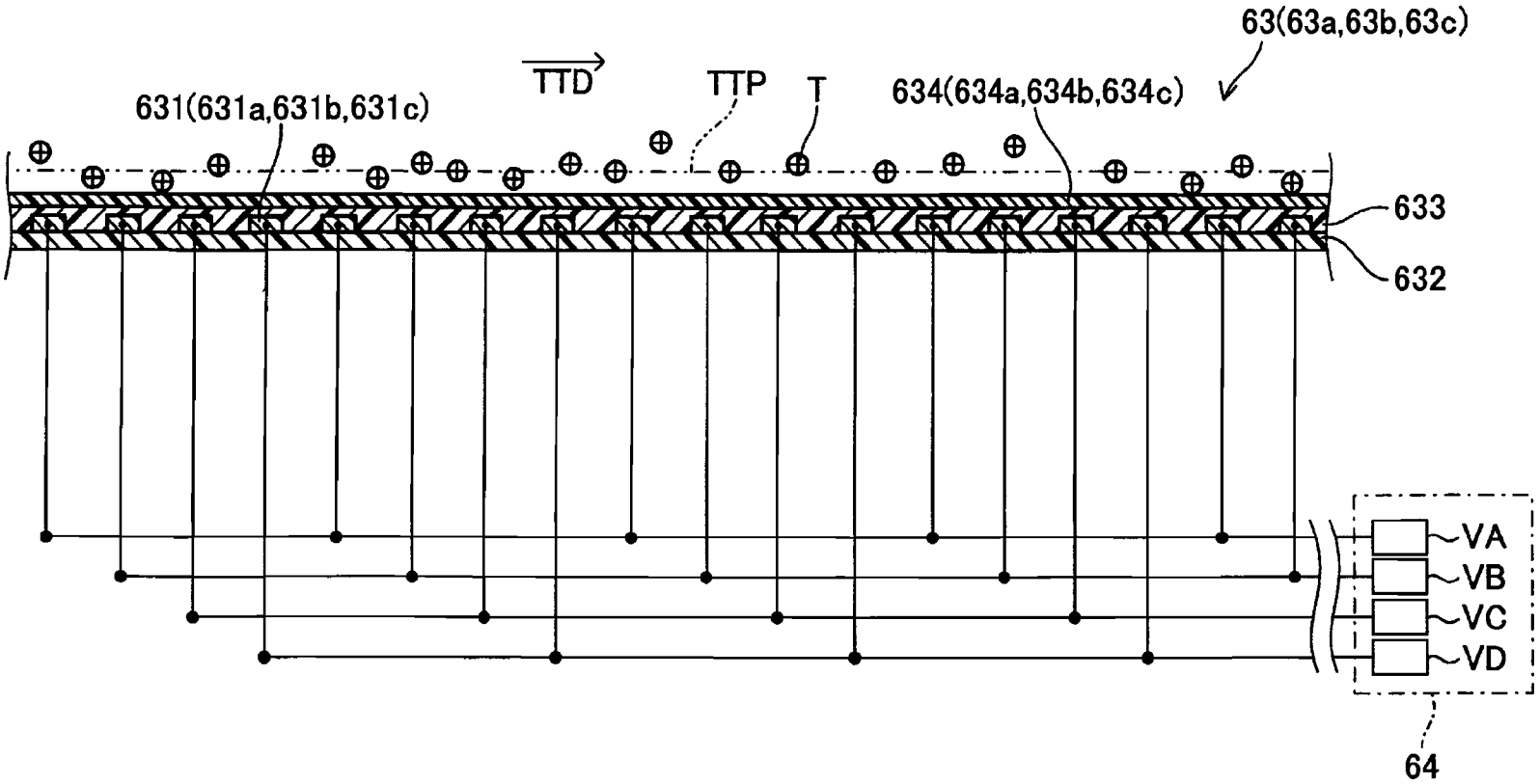
FIG. 3 is an enlarged side cross section of a carrying substrate shown in FIG. 2.

Hereafter, the carrying substrate 63 is explained in detail. As shown in FIG. 3, the carrying substrate 63 is a thin plate-like member. The carrying substrate 63 has a structure substantially equal to an FPC (Flexible Printed Circuit). More specifically, the carrying substrate 63 includes the carrying electrodes 631, an electrode support film 632, an electrode coating 633 and an electrode overcoating 634.

The carrying electrodes 631 are formed as linear patterns, each of which is elongated in parallel with the main scanning direction perpendicular to the auxiliary scanning direction and is formed of copper foil having a thickness of several tens of μm. The plurality of carrying electrodes 631 are aligned in parallel with each other and are arranged in the toner transport path TTP.

Hereafter, the carrying electrodes 631 on the bottom carrying substrate 63*a*, the carrying electrodes 631 on the supply substrate 63*b*, the carrying electrodes 631 on the collecting substrate 63*c* are frequently referred to as bottom carrying electrodes 631*a*, supply electrodes 631*b* and collecting electrodes 631*c*, respectively.

As shown in FIG. 3, the plurality of carrying electrodes 631 aligned along the toner transport path TTP are connected to power supply circuits VA, VB, VC and VD such that the carrying electrodes 631 are connected to the same power supply circuit at every four intervals. That is, the carrying electrode connected to the power supply circuit VA, the carrying electrode connected to the power supply circuit VB, the carrying electrode connected to the power supply circuit VC, the carrying electrode connected to the power supply circuit VD, the carrying electrode connected to the power supply circuit VA, the carrying electrode connected to the power supply circuit VB, the carrying electrode connected to the power supply circuit VC and the carrying electrode connected to the power supply circuit VD . . . are repeatedly arranged in this order along the toner transport path TTP. It should be noted that the power supply circuits VA, VB, VC and VD are provided in the power supply circuit 64.

Figure 4:
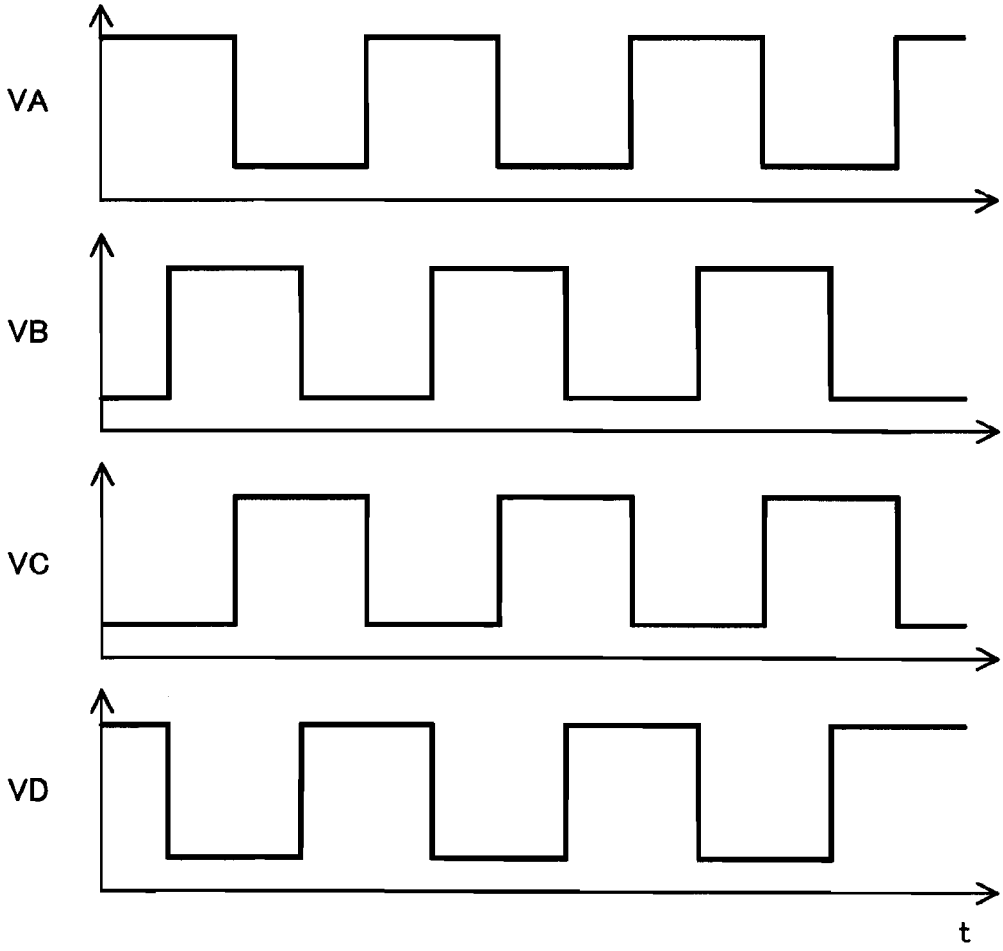
FIG. 4 is a timing chart illustrating waveforms of output signals of power supply circuits.

As shown in FIG. 4, the power supply circuits VA to VD output substantially the same driving voltages (i.e., alternating voltages). The phases of the output voltages of the power supply circuits VA to VD are shift with respect to each other by 90°. That is, in the order of the output signals of the power supply circuits VA to VD, each of the voltage phases of the output signals delays by 90°.

By applying the above described driving voltages to the carrying electrodes 631, the carrying substrate 63 generates a traveling electric field along the toner transport path TTP so that the positively charged toner T is carried in the toner transport direction TTD.

The plurality of carrying electrodes 631 are formed on the electrode support film 632. The electrode support film 632 is an elastic film, for example, made of insulating synthetic resin such as polyimide resin.

The electrode coating 633 is made of insulating synthetic resin. The electrode coating 633 is provided to cover the carrying electrodes 631 and a surface of the electrode support film 632 on which the carrying electrodes 631 are formed.

On the electrode coating 633, the electrode overcoating 634 is formed. Hereafter, the electrode overcoating 634 formed on the bottom carrying substrate 63*a*, the electrode overcoating 634 formed on the supply substrate 63*b* and the electrode overcoating 634 formed on the collecting substrate 63*c* are frequently referred to as a bottom overcoating 634*a*, a vertical overcoating 634*b*, a collecting overcoating 634*c*, respectively. That is, the electrode coating 633 is formed between the electrode overcoating 634 and the carrying electrodes 631. A surface of the electrode overcoating 634 is formed to be a smooth flat surface without bumps and dips so that the toner T can be carried smoothly.

In this embodiment, the vertical overcoating 634*b* and the collecting overcoating 634*c* are made of the same material (e.g., polyester). That is, as the material of the vertical overcoating 634*b* and the collecting overcoating 634*c*, material having a triboelectrification position on the plus side in the triboelectrification order with respect to the material (polyimide) of the bottom overcoating 634*a* is adopted. That is, the material of the vertical overcoating 634*b* and the collecting overcoating 634*c* has the same electrification polarity as that of the material of the toner T with respect to the material of the bottom overcoating 634*a*.

Figure 5:
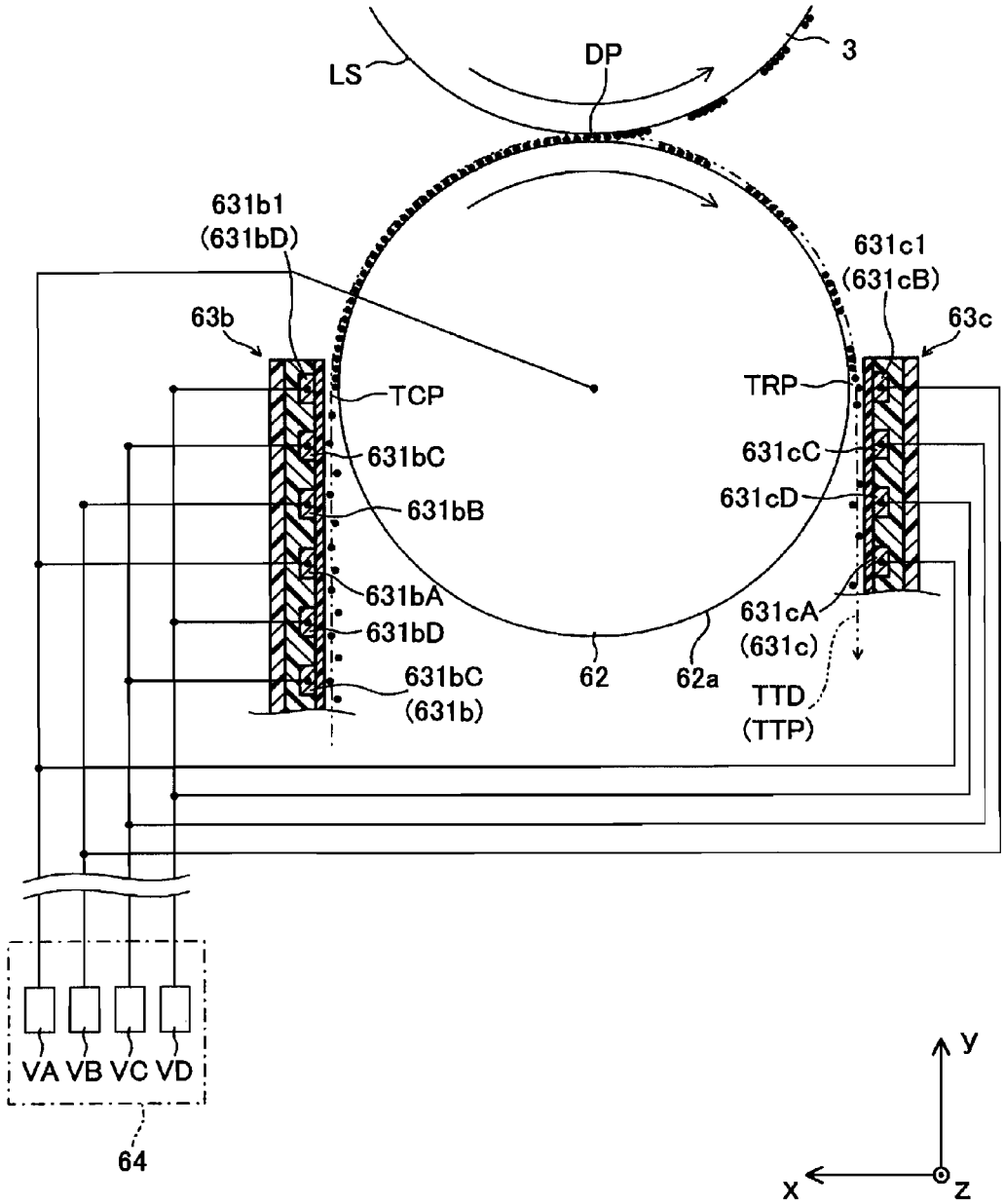
FIG. 5 is a side cross section illustrating a main portion of the toner supply unit shown in FIG. 1.

Hereafter, a main configuration around the toner catching position and the toner recovering position is explained in detail with reference to FIG. 5. In FIG. 5, the toner box 61 is omitted for the sake of simplicity.

As shown in FIG. 5, the supply substrate 63*b* and the development roller 62 are located such that a most downstream supply electrode 631*b*1 (which is a most downstream one of the plurality of supply electrodes 631*b* provided on the supply substrate 63*b* along the toner transport path TTP) is positioned to be closest to the toner holding surface 62*a*. That is, the most downstream supply electrode 631*b*1 is located at the position corresponding to the toner catching position TCP at which the supply substrate 63*b* and the toner holding surface 62*a* of the development roller 62 are closest to each other.

As shown in FIG. 5, the supply electrodes 631*b*A, 631*b*B, 631*b*C, 631*b*D, 631*b*A . . . are arranged along the toner transport direction TTD on the supply substrate 63*b*. In this case, the supply substrate 631*b*X means the supply electrode 631*b* connected to the power supply circuit VX (where X denotes one of A, B, C and D), which also apply to the notation of the collecting electrodes 631*c*A, 631*c*B, 631*c*C, 631*c* D and 631*c*A . . . .

To the most downstream supply electrode 631*b*1, the voltage having the phase which is delayed by one phase relative to the phase of the voltage applied to the neighboring supply electrode 631*b* located at an immediately upstream position with respect to the most downstream supply electrode 631*b*. That is, in this embodiment, the supply electrode 631*b*C adjacent to the most downstream supply electrode 631*b*1 on the upstream side in the toner transport direction TTD is connected to the power supply circuit VC. Further, the most downstream supply electrode 631*b*1 adjacent to the above described supply electrode 631*b*C is connected to the power supply circuit VD.

In this embodiment, to the development roller 62, the voltage which is delayed by one phase relative to the most downstream supply electrode 631*b*1 is applied. That is, the development roller 62 is connected to the power supply circuit VA.

Furthermore, to a most upstream collecting electrode 631*c*1 (which is a most upstream one of the plurality of collecting electrodes 631*c* arranged along the toner transport path TTP on the collecting substrate 63*c*), the voltage which is delayed by one phase relative to the phase of the voltage applied to the development roller 62 is applied. That is, in this embodiment, the most upstream collecting electrode 631*c*1 is connected to the power supply circuit VB.

The most upstream collecting electrode 631*c*1 is located at the position corresponding to the toner recovering position TRP at which the collecting substrate 63*c* is closest to the toner holding surface 62*a* of the development roller 62. On the downstream side of the most upstream collecting electrode 631*c*1 in the toner transport direction TTD, the collecting electrodes 631*c*C, 631*c*D, 631*c*A . . . are arranged in this order in the toner transport direction TTD.

Hereafter, operations of the laser printer 1 are explained.

As shown in FIG. 1, the leading edge of the sheet of paper P placed on the paper supply tray (not shown) is carried to the registration roller 21. Then, skew of the sheet of paper P is corrected, and the carrying timing is adjusted. Thereafter, the sheet of paper P is carried to the transfer position TP.

While the sheet of paper P is carried to the transfer position TP, an image formed by the toner T is formed on the electrostatic latent image holding surface LS as described below.

The electrostatic latent image holding surface LS of the photosensitive drum 3 is charged by the charger 4 positively and uniformly. The electrostatic latent image holding surface LS charged by the charger 4 moves along the auxiliary scanning direction by rotation in the direction indicated by the arrow in FIG. 1 to reach the scan position SP facing the scanning unit 5.

At the scan position SP, the laser beam LB modulated by image information scans on the electrostatic latent image holding surface LS in the main scanning direction. In accordance with a modulated state of the laser beam LB, the positive charges of the electrostatic latent image holding surface LS are partially removed. As a result, a pattern of the positive charges (corresponding to an image to be formed) appears as an electrostatic latent image.

The electrostatic latent image formed on the electrostatic latent image holding surface LS moves to the development position DP facing the toner supply unit 6 by rotation of the photosensitive drum 3 in the direction indicated y the arrow in FIG. 1 (i.e., in the counterclockwise direction).

Referring now to FIGS. 2 and 3, the toner T stored in the toner box 61 charges, for example, by contact and friction with respect to the bottom overcoating 634*a* of the bottom carrying substrate 63*a*. The charged toner T which contacts or is situated closely to the bottom overcoating 634*a* of the bottom carrying substrate 63*a* is carried in the toner transport direction TTD by the electric field generated by the voltage applied to the bottom carrying substrate 631*a*, and is passed to the supply substrate 63*b*.

In this embodiment, the downstream end portion of the bottom carrying substrate 63*a* along the toner transport direction TTD (i.e., a connection part of the bottom carrying substrate 63*a* with respect to the supply substrate 63*b*) is formed to be a curved surface. Consequently, it becomes possible to smoothly pass the toner T from the bottom carrying substrate 63*a* to the lower end portion of the supply substrate 63*b*.

The supply substrate 63*b* carries upward the toner T which has been passed at the lower end portion thereof from the bottom carrying substrate 63*a*. Since the vertical overcoating 634*b* of the supply substrate 63*b* has the lower degree of effect of further charging positively the toner T than that of the bottom overcoating 634*a* of the bottom carrying substrate 63*a*, it becomes possible to prevent the charged state of the toner T being carried along the supply substrate 63*b* from being altered.

It should be noted that toner not properly charged (e.g., toner charged negatively or non-charged toner) has been mixed into the toner T passed from the bottom carrying substrate 63*a*. However, when the toner T is carried upward in the vertical direction along the supply substrate 63*b* to the toner catching position TCP or when the positively charged toner T is held on the development roller 62 at the toner catching position TCP through the electric field formed between the supply substrate 63*b* and the development roller 62, the toner not properly charged deviates from the toner transport path TTP and then falls downward from the supply substrate 63*b*.

With this configuration, only the toner T in a suitably charged state can be selectively carried to the toner catching position TCP. That is, on the supply substrate 63*b*, the toner not properly charged is separated from the toner T suitably charged. The toner which has fallen downward from the supply substrate 63*b* is circulated to the toner reservoir part 61*a*, and then is carried again upward to the toner catching portion TCP along the supply substrate 63*b*.

As described above, the positively charged toner T is carried to the toner catching position TCP along the supply substrate 63*b*. As shown in FIGS. 4 and 5, the multiphase alternating voltages which are in synchronization with the voltage applied to the supply electrodes 631*b* is applied to the development roller 62. More specifically, to the development roller 62 connected o the power supply circuit VA, the voltage which is delayed by one phase relative to the voltage of the most downstream supply electrode 631*b*1 is applied.

In this case, the electric field which is equivalent to the traveling electric field carrying the toner T on the supply substrate 63*b* in the toner transport direction TTD is formed at the toner catching position TCP between the most downstream supply electrode 631*b*1 and the toner holding surface 62*a* of the development roller 62. In this case, the voltage applied to the toner catching position TCP does not include a relatively large D.C. bias for moving the positively charged toner T to the development roller 62. As a result, the toner T smoothly moves to the development roller 62 through the traveling electric field generated by the multiphase alternating voltage outputted by the power supply circuit 64, and is suitably held o the toner holding surface 62*a* of the development roller 62.

The positively charged toner T is thus supplied to the development position DP. In the vicinity of the development position DP, the electrostatic latent image formed on the electrostatic latent image holding surface LS is developed with the toner T. That is, the toner T adheres to a part of the electrostatic latent image holding surface LS where positive charges of the electrostatic latent image are removed. As a result, an image formed by the toner T (hereafter, referred to as a toner image) is held on the electrostatic latent image holding surface LS.

The toner T which is held on the toner holding surface 62*a* and has passed the development position DP (i.e., the toner T which has not consumed at the development position DP) moves to the toner recovering position TRP. As shown in FIGS. 4 and 5, to the development roller 62, the multiphase alternating voltage which is in synchronization with the voltage applied to the collecting electrodes 631*c* is applied. More specifically, to the development roller 62 connected to the power supply circuit VB, the voltage which precedes by one phase relative to the voltage applied to the most upstream collecting electrode 631*c*1 is applied.

In this case, the electric field which is equivalent to the traveling electric field for carrying the toner T on the collecting substrate 63*c* in the toner transport direction TTD is formed at the toner recovering position TRP between the most upstream collecting electrode 631*c*1 and the toner holding surface 62*a* of the development roller 62.

In this case, the voltage applied to the toner recovering position TRP does not include a relatively large D.C. bias for moving, toward the collecting substrate 62*c*, the toner T adhered firmly to the toner holding surface 62*a* through an image force and Vander Waals' force.

Therefore, the toner T is smoothly moved from the development roller 62 to the collecting substrate 63*c* through the traveling electric field generated at the toner recovering position TRP by the multiphase alternating voltage outputted by the power supply circuit 64. That is, the toner T is collected by the collecting substrate 63*c* from the toner holding surface 62*a* at the toner recovering position TRP. Then, the collected toner T is suitably carried in the toner transport direction TTD without being pressed against the collecting substrate 63*c* by the above described relatively larger D.C. bias.

In addition, the voltage applied to the development roller 62 serves as a development bias for causing a so-called jumping phenomenon at the development position DP. Therefore, the development bias can be achieved with a simple structure.

At the lower end portion of the collecting substrate 63*c*, the toner T is carried downwardly in the vertical direction. In this case, the inertia having the same direction as that of gravity acts on the toner T. Further, in a downward portion with respect to the lower end of the collecting substrate 63*c*, the toner T falls toward the toner reservoir part 61*a* by the effect of the gravity and the inertia having the same direction as that of the gravity. Therefore, the toner T suitably circulates to the toner reservoir part 61*a* even when the collecting substrate 63*c* is not formed to reach the toner reservoir part 61*a*.

As shown in FIG. 1, the toner image held on the electrostatic latent image holding surface LS of the photosensitive drum 3 is carried to the transfer position TP by rotation in the direction shown in FIG. 1 of the electrostatic latent image holding surface LS (i.e., in the counterclockwise direction). Then, the toner image is transferred from the electrostatic latent image holding surface LS to the sheet of paper P at the transfer position TP.

Hereafter, a first variation of the toner supply unit (a toner supply unit 6B) is explained with reference to FIGS. 6 and 7. It should be noted that in FIGS. 6 and 7, to elements which are substantially the same as those shown in the above described embodiment, the same reference numbers are assigned, and explanations thereof will not be repeated for the sake of simplicity.

Figure 6:
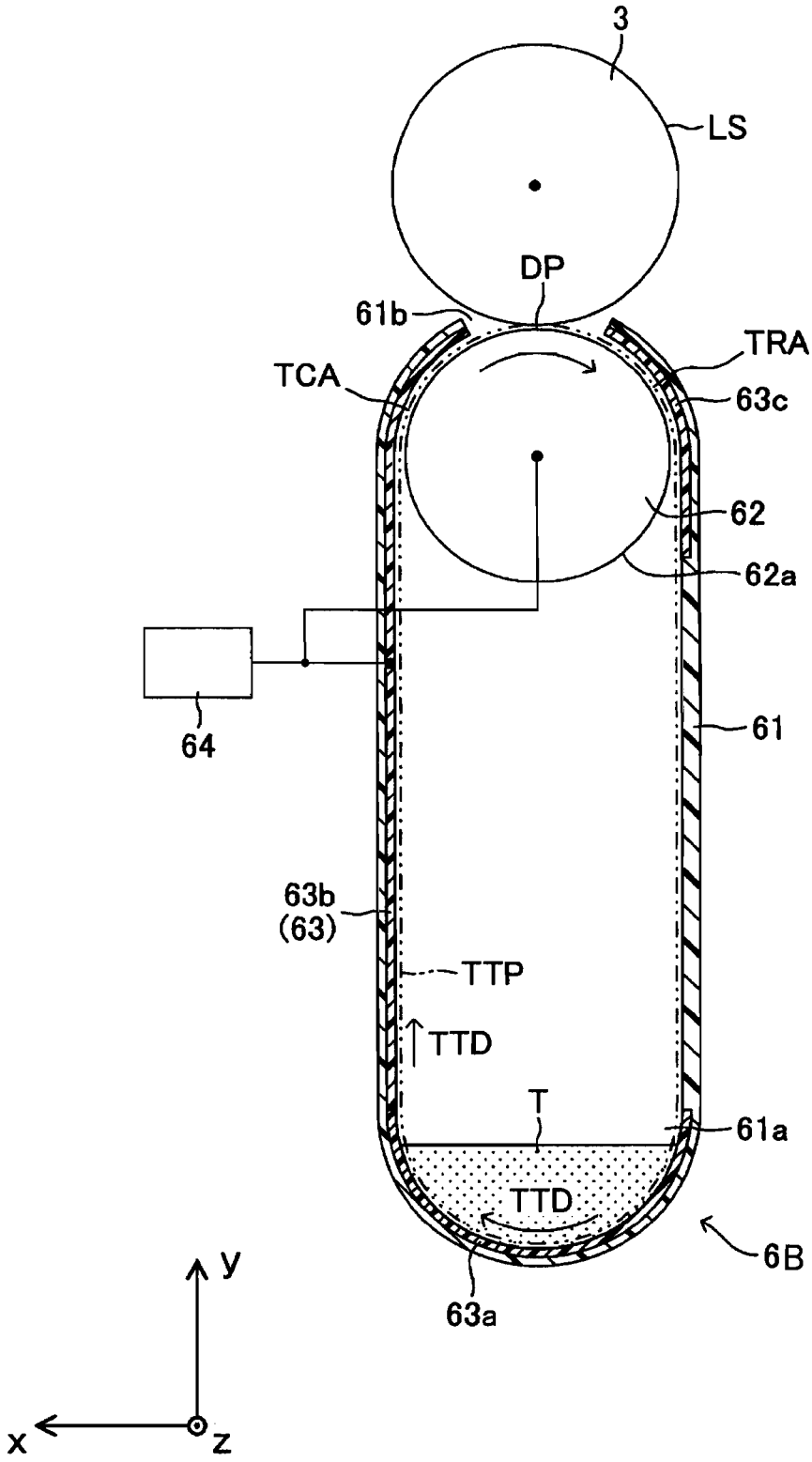
FIG. 6 is an enlarged side cross section illustrating a toner supply unit according to a first variation.
Figure 7:
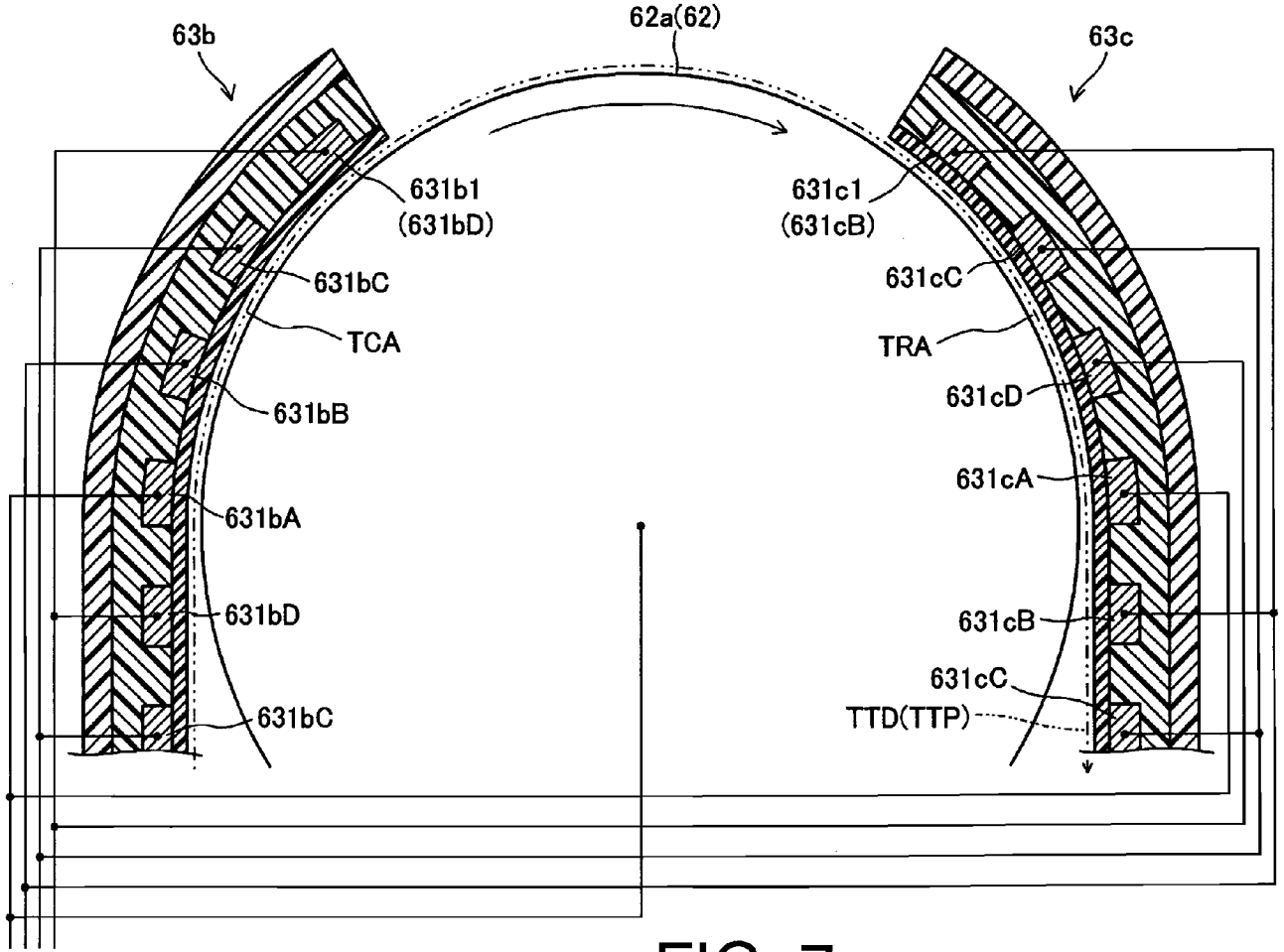
FIG. 7 is an enlarged side cross section of a carrying substrate provided in the toner supply unit shown in FIG. 6.

As shown in FIGS. 6 and 7, each of the upper end portions of the supply substrate 63*b* and the collecting substrate 63*c* is formed to be a curved portion which is curved along the cylindrical surface of the development roller 62.

In this variation, the top end of the supply substrate 63*b* is provided to reach the position higher than the center of the development roller 62. That is, the top end of the supply substrate 63*b* is formed to reach the opening 61*b*. The upper end portion is formed to be a recessed curved portion so as to face with the cylindrical toner holding surface 62*a* of the development roller 62 via a constant interval (e.g., approximately 300 μm).

In this variation, the upper end portion of the collecting substrate 63*c* is formed to be a recessed portion so as to face with the development roller 62 via a constant interval (e.g., approximately 300 μm) which is narrower than the gap formed at the development position DP between the photosensitive drum 3 and the development roller 62. Furthermore, the lower end portion of the collecting substrate 63*c* is formed to carry downward the toner T in the vertical direction.

As shown in FIG. 7, in contrast to the configuration of the above described embodiment where only the most downstream supply electrode 631*b*1 is located to be closest to the toner holding surface 62*a*, in the first variation a plurality of supply electrodes 631*b* including the most downstream supply electrode 631*b*1 are provided at a toner catching area TCA where the upper end portion of the supply substrate 63*b* faces the toner holding surface 62*a*.

In addition, in contrast to the configuration of the above described embodiment where only the most upstream collecting electrode 631*c*1 is located to be closest to the toner holding surface 62*a*, in the first variation a plurality of collecting electrodes 631*c* including the most upstream collecting electrode 631*c*1 are provided at a toner recovering area TRA where the upper end portion of the collecting substrate 63*c* faces the toner holding surface 62*a*.

In the first variation, the frequency of the output voltage of the power supply circuit 64 is defined such that the carrying speed of the toner T in the toner transport direction TTD by the carrying substrate 63 (i.e., the supply substrate 63*b* and the collecting substrate 63*c*) is set to be larger than or equal to a value which is twice as large as the moving speed of the toner holding surface 62*a* by rotation of the development roller 62. As a result, the toner T can be suitably held on the toner holding surface 62*a*, and the toner T can be suitably collected from the toner holding surface 62*a*.

Figure 8:
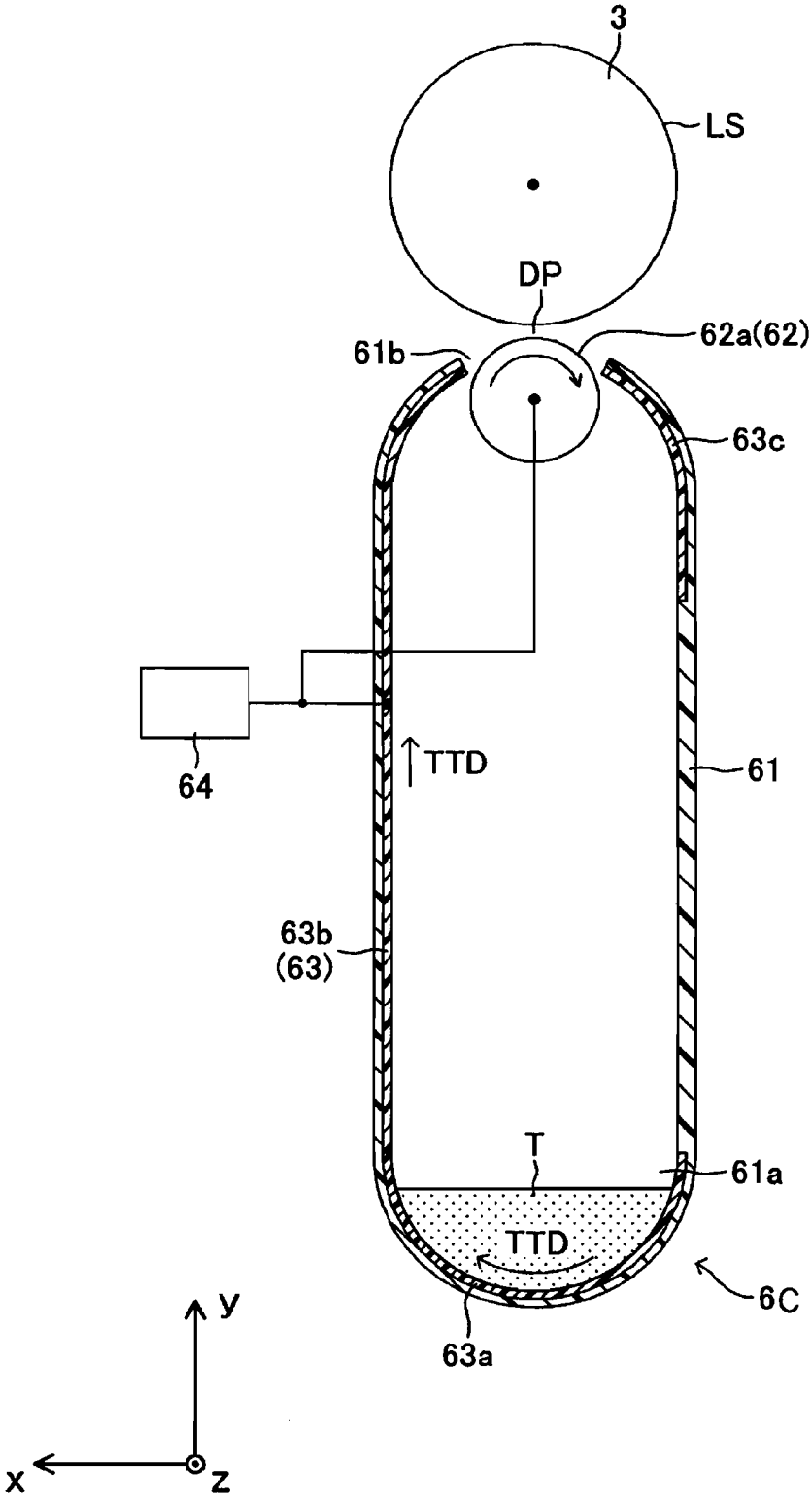
FIG. 8 is an enlarged side cross section illustrating a toner supply unit according to a second variation.

Hereafter, a second variation of the toner supply unit (a toner supply unit 6C) is explained with reference to FIGS. 8 and 9. It should be noted that in FIGS. 8 and 9, to elements which are substantially the same as those show in the above described embodiment, the same reference numbers are assigned, and explanations thereof will not be repeated for the sake of simplicity.

As in the case of the above described embodiment, in the second variation, only the most downstream supply electrode 631*b*1 of the plurality of supply electrodes 631*b* is located to be closest to the toner holding surface 62*a*. Further, only the most upstream supply electrode 631*c*1 of the plurality of collecting electrodes 631*c* is located to be closest to the toner holding surface 62*a*.

In this configuration, the toner T can be suitably held on the toner holding surface 62*a*, and the toner T can be suitably collected from the toner holding surface 62*a*.

Figure 9:
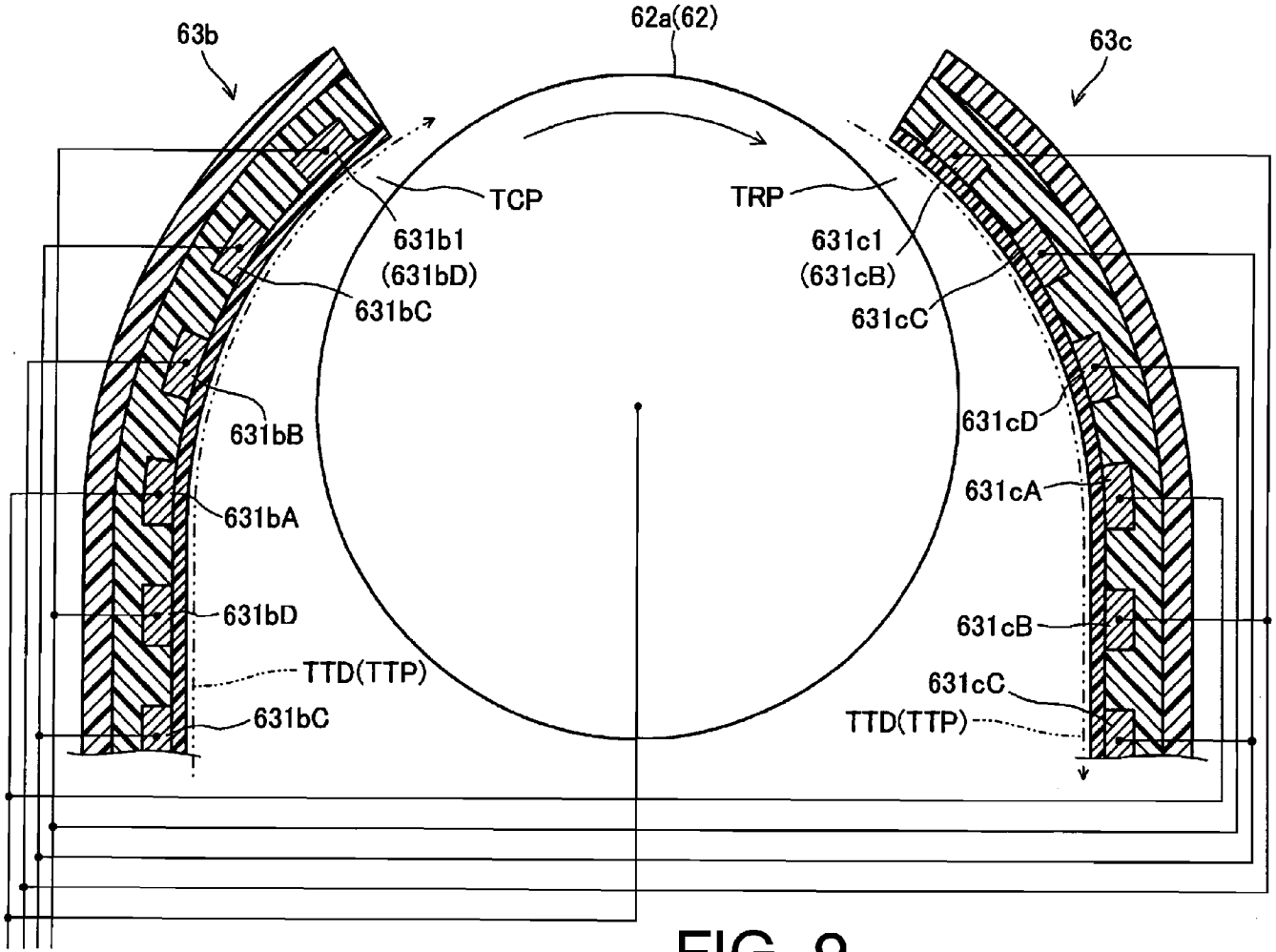
FIG. 9 is an enlarged side cross section of a carrying substrate provided in the toner supply unit shown in FIG. 8.

In particular, as shown in FIG. 9, a part of the toner holding surface 62*a* at which the toner T is supplied from the most downstream supply electrode 631*b*1 to the toner holding surface 62*a* is formed to be along the toner transport direction TTD defined at the position corresponding to the most downstream supply electrode 631*b*1 on the toner transport path TTP. In other words, the part of the toner holding surface 62*a* at which the toner T is supplied from the most downstream supply electrode 631*b*1 to the toner holding surface 62*a* is formed to be a tangential direction of the toner transport path TTP defined at the position corresponding to the most downstream supply electrode 631*b*1. As a result, the toner T can be suitably moved from the supply electrode 63*b* to the development roller 62, and the toner T can be suitably held on the toner holding surface 62*a*.

As shown in FIG. 9, a part of the toner holding surface 62*a* at which the toner T is collected by the most upstream supply electrode 631*c*1 is formed to be along the toner transport direction TTD defined at the position corresponding to the most upstream supply electrode 631*c*1 on the toner transport path TTP. In other words, the part of the toner holding surface 62*a* at which the toner T is collected by the most upstream supply electrode 631*c*1 is formed to be a tangential direction of the toner transport path TTP defined at the position corresponding to the most upstream supply electrode 631*c*1. With this configuration, the toner can be smoothly moved from the development roller 62 to the collecting substrate 63*c*. As a result, the toner T can be suitably collected from the toner holding surface 62*a* to the collecting substrate 63*c*, and the toner T can be suitably carried in the toner transport direction TTD.

Figure 10:
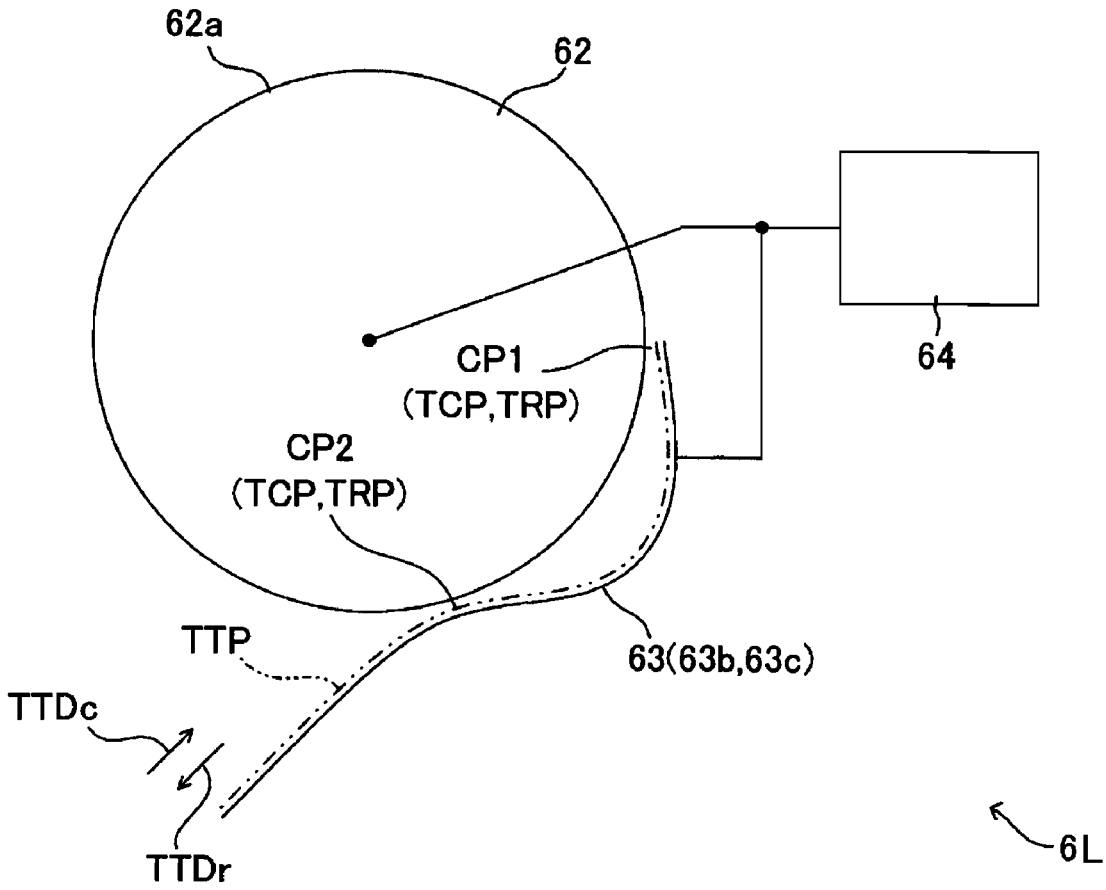
FIG. 10 is a side cross section illustrating a configuration of a toner supply unit according to a third variation.

Hereafter, a third variation of the toner supply unit (a toner supply unit 6L) is explained with reference to FIG. 10. It should be noted that in FIG. 10, to elements which are substantially the same as those show in the above described embodiment, the same reference numbers are assigned, and explanations thereof will not be repeated for the sake of simplicity. As shown in FIG. 10, the toner supply unit 6L according to the third variation is formed such that the carrying substrate 63 has two positions closely located with respect to the toner holding surface 62*a*.

That is, the supply substrate 63*b* and the development roller 62 are located so that a plurality of toner catching positions TCP are provided. With this configuration, the toner T can be holed on the toner holding surface 62*a* more suitably.

In FIG. 10, a toner transport direction TTDc represents a toner transport direction defined if the carrying substrate 63 is the supply substrate 63*b*. In this case, the toner supply unit 6L according to the third variation is configured to satisfy the following condition:

$$L=n\cdot k\cdot p=[\{m+(1/2)\}\cdot f]/v \quad (1)$$

where L represents a distance between two neighboring toner catching positions TCP (i.e., a distance between the first facing position CP1 and the second facing position CP2) along the toner transport direction TTDc, v represents a moving speed of the toner holding surface 62*a* by rotation of the development roller 62, f represents a frequency of the multiphase alternating voltage in a traveling waveform applied to the supply electrodes 631*b* and the development roller 62, k represents the number of phases of the multiphase alternating voltage in a traveling waveform applied to the supply electrodes 631*b* and the development roller 62, p represents a pitch of the plurality of supply electrodes 631*b*, and m and n are integers.

More specifically, when the multiphase alternating voltage is the four-phase, and the moving speed v of the toner holding surface 62*a* and the toner carrying speed of the toner by the supply substrate 63*b* in the toner transport direction TTDc are equal to each other, the voltage which is shifted by two phases relative to the phase of the voltage applied to the supply electrode 631*b* at the first facing position CP1 is applied to the supply electrode 631*b* at the second facing position CP2.

With this configuration, the toner T can be suitably moved, at the first facing position CP1, to a position on the toner holding surface 62*a* to which the toner T has not been moved from the carrying substrate 63 at the second facing position CP2. As a result, the toner T can be held on the toner holding surface 62*a* more suitably.

Alternatively, as shown in FIG. 10, the collecting substrate 63*c* and the development roller 62 may be arranged such that more than one toner recovering position TRP are provided. With this configuration, the toner can be collected from the toner holding surface 62*a* more stably. In FIG. 10, the toner transport direction TTDr represents a toner transport direction defined when the carrying substrate 63 is the collecting substrate 63*c*. In this case, the toner supply unit 6L according to the third variation is configured to satisfy the following condition:

$$L=n\cdot k\cdot p=[\{m+(1/2)\}\cdot f]/v \quad (2)$$

where L represents a distance between two neighboring toner recovering positions TRP (i.e., a distance between the first facing position CP1 and the second facing position CP2) along the toner transport direction TTDr, v represents a moving speed of the toner holding surface 62*a* by rotation of the development roller 62, f represents a frequency of the multiphase alternating voltage in a traveling waveform applied to the collecting electrodes 631*c* and the development roller 62, k represents the number of phases of the multiphase alternating voltage in a traveling waveform applied to the collecting electrodes 631*c* and the development roller 62, p represents a pitch of the plurality of collecting electrodes 631*c*, and m and n are integers.

More specifically, when the multiphase alternating voltage is the four-phase, and the moving speed v of the toner holding surface 62*a* and the toner carrying speed of the toner by the collecting substrate 63*c* in the toner transport direction TTDr are equal to each other, the voltage which is shifted by two phases relative to the phase of the voltage applied to the supply electrode 631*c* at the first facing position CP1 is applied to the supply electrode 631*c* at the second facing position CP2.

With this configuration, the toner T which has not been collected at the first facing position CP and remains on the toner holding surface 62*a* can be suitably collected from the toner holding surface 62*a* at the second facing position CP2. As a result, the toner remaining on the toner holding surface 62*a* can be suitably collected, and therefore it becomes possible to suitably prevent a ghost image from occurring on the formed image.

Second Embodiment

Figure 11:
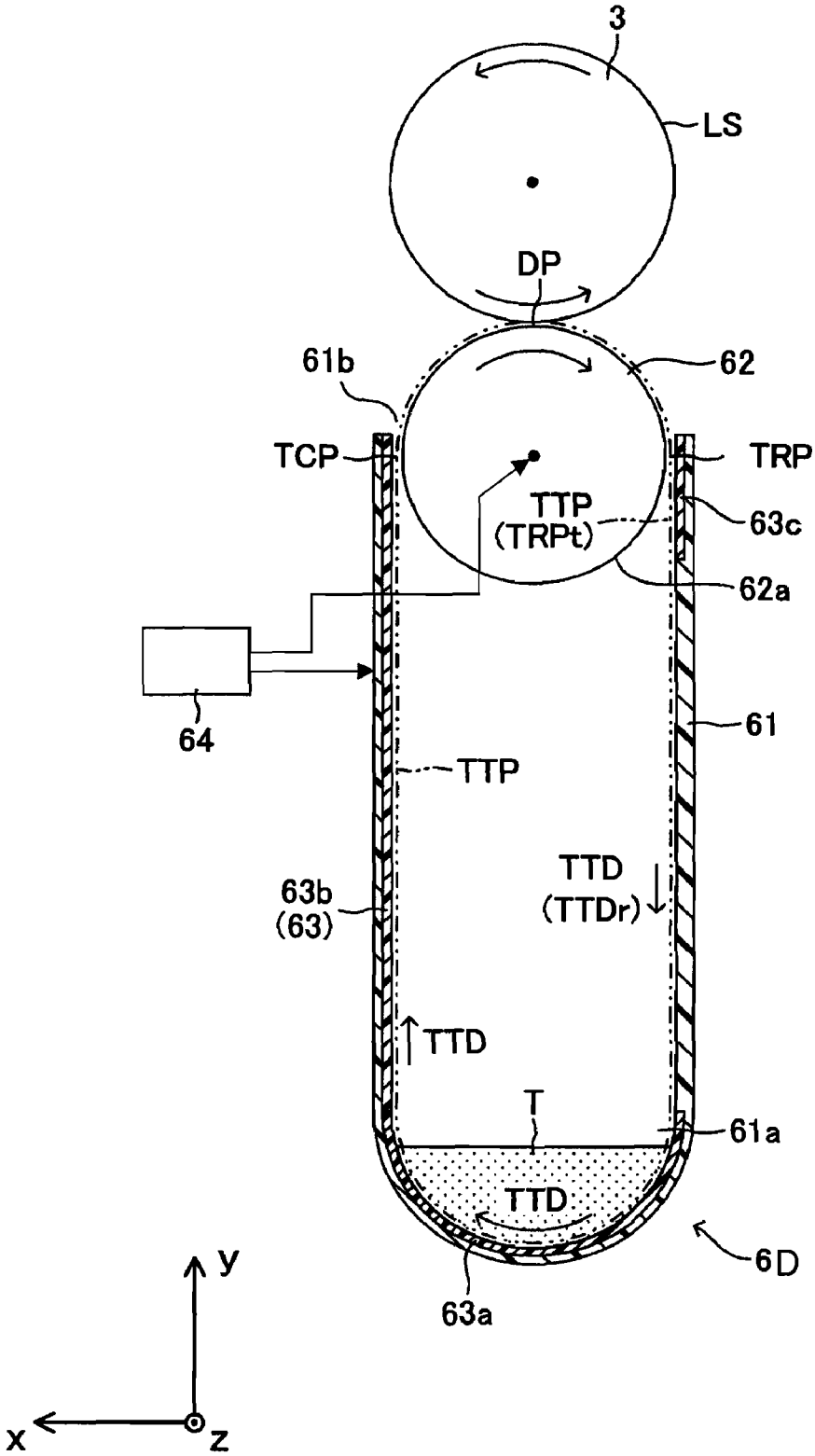
FIG. 11 is a side cross section illustrating a configuration of a toner supply unit according to a second embodiment.

Hereafter, a second embodiment of a toner supply unit is explained. In the following, to elements which are substantially the same as those of the first embodiment, the same reference numbers are assigned, and explanations thereof will not be repeated. The toner supply unit 6B shown in FIG. 11 is arranged in the laser printer 1 shown in FIG. 1. In the following, explanations focus on the feature of the second embodiment.

As shown in FIG. 11, the toner supply unit 6D is configured to supply the charged toner T to the photosensitive drum 3 by carrying the charged toner T through an electric field along a toner transport path TTP.

A toner box 61 serving as a casing of the toner supply unit 6D is a box type member having an elliptical shape when viewed as a side cross section, and is positioned such that the longer side thereof is in parallel with the vertical direction (i.e., the direction of y-axis). Inside the toner box 61, the toner T which is dry type powdery developer is accommodated. That is, a toner reservoir part 61*a* is formed by semicylindrical inside space formed at the lower end portion of the toner box 61. In this embodiment, the toner T has a positive electrostatic property, and is single component black toner having a nonmagnetic property.

At the top of the toner box 61 (i.e., the position facing the photosensitive drum 3), an opening 61*b* is formed. The opening 61*b* is formed so that the toner box 61 is opened upward toward the photosensitive drum 3. In this embodiment, the opening 61*b* is formed throughout the length of the inner space of the toner box 61 in a depth direction (i.e., in the main scanning direction).

Inside the toner box 61, a development roller 62 serving as a developer holding body is accommodated. The development roller 62 is a roller-like member having a toner holding surface 62*a* which is a cylindrical circumferential surface. The development roller 62 is located to face the photosensitive drum 3 through the opening 61*b*. That is, the toner box 61 and the development roller 62 are located so that, at the development position DP, the toner holding surface 62*a* of the development roller 62 is located closely to the electrostatic latent image holding surface LS of the photosensitive drum 3 via a gap having a predetermined interval (e.g., approximately 500 μm).

The development roller 62 is held at the upper end portion of the toner box 61 where the opening 61*b* is formed so that the development roller 62 is rotatable about an axis extending in the main scanning direction. In this embodiment, the development roller 62 is accommodated in the toner box 61 such that the rotation center axis of the development roller is inside the toner box 61 and an approximately half of the toner holding surface 62*a* is exposed to the outside of the toner box 61.

Inside the toner box 61, a carrying substrate 63 is provided along the toner transport path TTP. The carrying substrate 63 is fixed on the inner wall of the toner box 61. In this embodiment, the carrying substrate 63 includes a bottom carrying substrate 63*a*, a supply substrate 63*b* and a collecting substrate 63*c*. The inner configuration of the carrying substrate 63 is explained in detail later.

The toner transport direction TTD in which the positively charged toner T is carried by the carrying substrate 63 is equal to a direction tangential to the toner transport path TTP at any points along the toner transport path TTP. In the following, a part of the toner transport path TTP on the side of the collecting substrate 63*c* is frequently referred to as a toner recovering path TRPt, and the toner transport direction TTD along the toner recovering path TRPt is frequently referred to as a toner transport direction TTDr. That is, the toner transport direction TTDr is the toner transport direction TTD defined when the carrying substrate 63 is the collecting substrate 63*c*.

The bottom carrying substrate 63*a* is located at the bottom in the inner space of the toner box 61 to form the bottom surface of the toner reservoir part 61*a*. The bottom carrying substrate 63*a* is formed as a recessed curved surface which is curved to have a semicylindrical shape when viewed as a side cross section. Further, the bottom carrying substrate 63*a* is formed to smoothly connect to the lower end of the supply substrate 63*b*. The bottom carrying substrate 63*a* is connected to the lower end of the supply substrate 63*b* so that the toner T in the toner reservoir part 61*a* is carried to the lower end of the supply substrate 63*b*.

The supply substrate 63*b* which is a plate-like member is formed to stand in the vertical direction so that the toner T is carried upwardly in the vertical direction from the lower end portion thereof connected to the bottom carrying substrate 63*a*.

In this embodiment, the upper end (i.e., an downstream end in the toner transport direction TTD) of the supply substrate 63*b* is located at substantially the same height as that of the center of the development roller 62 (see FIG. 11). In this embodiment, the upper end of the supply substrate 63*b* is located slightly higher than the center of the development roller 62. The upper end of the supply substrate 63*b* faces the toner holding surface 62*a* of the development roller 62.

The upper end of the supply substrate 63*b* and the toner holding surface 62*a* face with each other, via a predetermined gap (e.g., approximately 300 μm) at a toner catching position TCP which is on the upstream side of the development position DP in the moving direction of the toner holding surface 62 of the development roller 62. That is, the upper end of the supply substrate 63*b* is closest to the toner holding surface 62*a* at the toner catching position TCP.

The supply substrate 63*b* is configured to carry the toner T which has been received from the bottom carrying substrate 63*a*, to the toner catching position TCP in the toner transport direction TTD.

The collecting substrate 63*c* is located to face the development roller 62 at the opposite position with respect to the upper end of the supply substrate 63*b* while sandwiching the development roller 62 between the collecting substrate 63*c* and the upper end of the supply substrate 63*b*. That is, the collecting substrate 63*c* is located on the downstream side in the toner transport direction TTD with respect to the opening 61*b* of the toner box 61. In this embodiment, the end part of the collecting substrate 63*c* in the toner transport direction TTDr is located at the position corresponding to the position of the lower end of the development roller 62.

In this embodiment, the upper end (i.e., an upstream side end in the toner transport direction TTDr) of the collecting substrate 63*c* is position at substantially the same height as that of the center of the development roller 62 (see FIG. 11). In this embodiment, the upper end of the collecting substrate 63*c* is located slightly higher than the center of the development roller 62. The upper end of the collecting substrate 63*c* faces the toner holding surface 62*a* of the development roller 62.

The upper end of the collecting substrate 63*c* and the toner holding surface 62*a* face with each other, via a predetermined gap (e.g., approximately 300 μm) at a toner recovering position TRP which is on the downstream side of the development position DP in the moving direction of the toner holding surface 62 of the development roller 62. That is, the upper end of the collecting substrate 63*c* is closest to the toner holding surface 62*a* at the toner recovering position TRP.

The collecting substrate 63*c* collects, from the development roller 62, the toner T which has not been consumed at the development position DP, and carries downward the collected toner T, toward the toner reservoir part 61*a*, along the toner recovering path TRPt in the toner transport direction TTDr.

The carrying substrate 63 and the development roller 62 are connected to a voltage application unit 64. The voltage application unit 64 outputs a voltage for circulating the toner T along the toner transport path TTP in the toner transport direction TTD (i.e., for carrying the toner T stored in the toner reservoir part 61*a* to the development roller to supply the toner held on the development roller to the development position DP, and for collecting, from the development roller 62, the toner T which has not been consumed at the development position DP to circulate the collected toner to the toner reservoir part 61*a*).

More specifically, the frequency of the output voltage of the voltage application unit 64 is defined such that the carrying speed of the toner T in the toner transport direction TTD is equal to the moving speed of the toner holding surface 62*a* by rotation of the development roller 62.

More specifically, the voltage application unit 64 (serving as a voltage application unit) is configured to apply a multiphase alternating voltage to a plurality of carrying electrodes 631 provided on the carrying substrate 63, and to apply, to the development roller 62, a voltage which is in synchronization with the multiphase alternating voltage applied to the carrying electrodes 631. Details concerning the voltage application from the voltage application unit 64 to the carrying substrate 63 and the development roller 62 are explained later.

Figure 12:
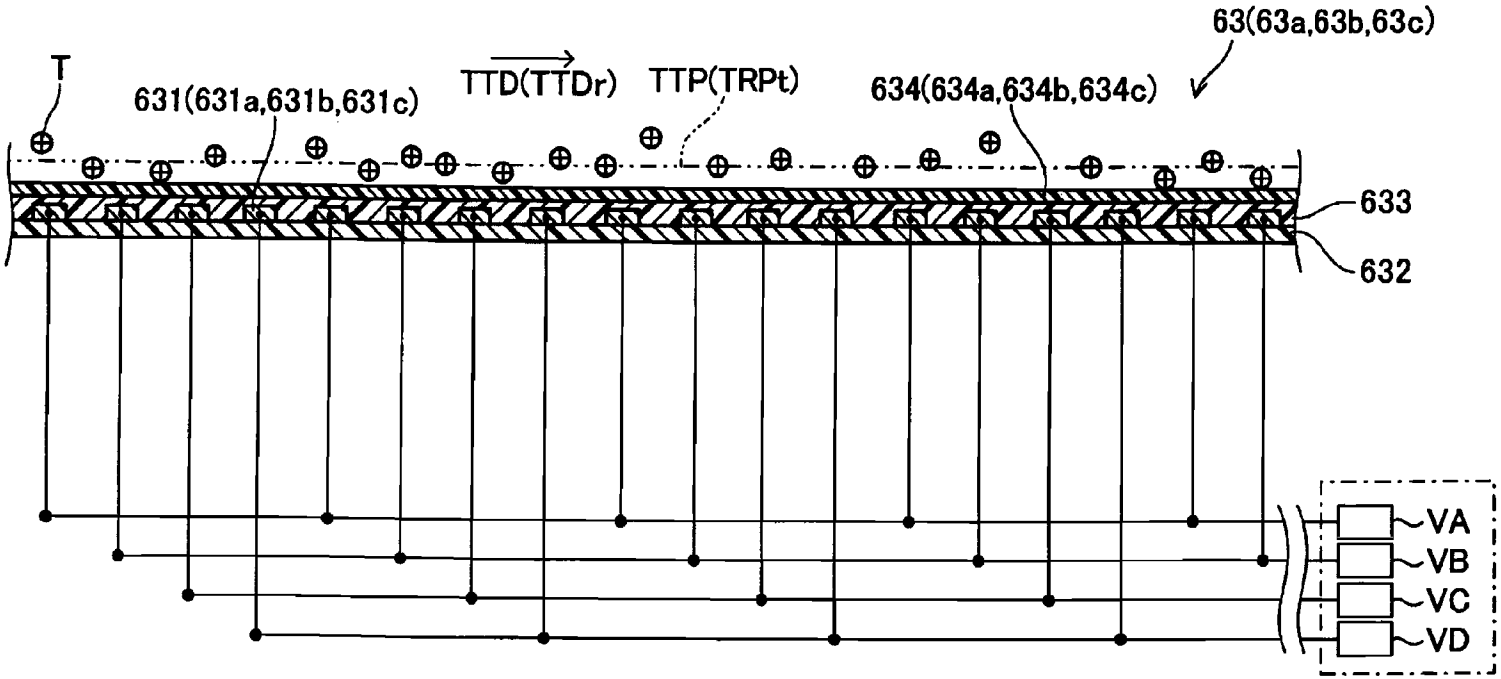
FIG. 12 is an enlarged side cross section of a carrying substrate shown in FIG. 11.

Hereafter, the carrying substrate 63 is explained in detail. As shown in FIG. 12, the carrying substrate 63 is a thin plate-like member. The carrying substrate 63 has a structure substantially equal to an FPC (Flexible Printed Circuit). More specifically, the carrying substrate 63 includes the carrying electrodes 631, an electrode support film 632, an electrode coating 633 and an electrode overcoating 634.

The carrying electrodes 631 are formed as linear patterns, each of which is elongated in parallel with the main scanning direction perpendicular to the auxiliary scanning direction and is formed of copper foil having a thickness of several tens of μm. The plurality of carrying electrodes 631 are aligned in parallel with each other and are arranged in the toner transport path TTP (or the toner recovering path TRPt).

Hereafter, the carrying electrodes 631 on the bottom carrying substrate 63*a*, the carrying electrodes 631 on the supply substrate 63*b*, the carrying electrodes 631 on the collecting substrate 63*c* are frequently referred to as bottom carrying electrodes 631*a*, supply electrodes 631*b* and collecting electrodes 631*c*, respectively.

As shown in FIG. 12, the plurality of carrying electrodes 631 aligned along the toner transport path TTP (or the toner recovering path TRPt) are connected to power supply circuits VA, VB, VC and VD such that the carrying electrodes 631 are connected to the same power supply circuit at every four intervals. That is, the carrying electrode connected to the power supply circuit VA, the carrying electrode connected to the power supply circuit VB, the carrying electrode connected to the power supply circuit VC, the carrying electrode connected to the power supply circuit VD, the carrying electrode connected to the power supply circuit VA, the carrying electrode connected to the power supply circuit VB, the carrying electrode connected to the power supply circuit VC and the carrying electrode connected to the power supply circuit VD . . . are repeatedly arranged in this order along the toner transport path TTP (or the toner recovering path TRPt). It should be noted that the power supply circuits VA, VB, VC and VD are provided in the voltage application unit 64.

As shown in FIG. 4, the power supply circuits VA to VD output substantially the same driving voltages (i.e., alternating voltages). The phases of the output voltages of the power supply circuits VA to VD are shift with respect to each other by 90°. That is, in the order of the output signals of the power supply circuits VA to VD, each of the voltage phases of the output signals delays by 90°.

By applying the above described driving voltages to the carrying electrodes 631, the carrying substrate 63 generates a traveling electric field along the toner transport path TTP (or the toner recovering path TRPt) so that the positively charged toner T is carried in the toner transport direction TTD (or TTDr).

The plurality of carrying electrodes 631 are formed on the electrode support film 632. The electrode support film 632 is an elastic film, for example, made of insulating synthetic resin such as polyimide resin.

The electrode coating 633 is made of insulating synthetic resin. The electrode coating 633 is provided to cover the carrying electrodes 631 and a surface of the electrode support film 632 on which the carrying electrodes 631 are formed.

On the electrode coating 633, the electrode overcoating 634 is formed. Hereafter, the electrode overcoating 634 formed on the bottom carrying substrate 63*a*, the electrode overcoating 634 formed on the supply substrate 63*b* and the electrode overcoating 634 formed on the collecting substrate 63*c* are frequently referred to as a bottom overcoating 634*a*, a vertical overcoating 634*b*, a collecting overcoating 634*c*, respectively. That is, the electrode coating 633 is formed between the electrode overcoating 634 and the carrying electrodes 631. A surface of the electrode overcoating 634 is formed to be a smooth flat surface without bumps and dips so that the toner T can be carried smoothly.

In this embodiment, the vertical overcoating 634*b* and the collecting overcoating 634*c* are made of the same material (e.g., polyester). That is, as the material of the vertical overcoating 634*b* and the collecting overcoating 634*c*, material having a triboelectrification position on the plus side in the triboelectrification order with respect to the material (polyimide) of the bottom overcoating 634*a* is adopted. That is, the material of the vertical overcoating 634*b* and the collecting overcoating 634*c* has the same electrification polarity as that of the material of the toner T with respect to the material of the bottom overcoating 634*a*.

Figure 13:
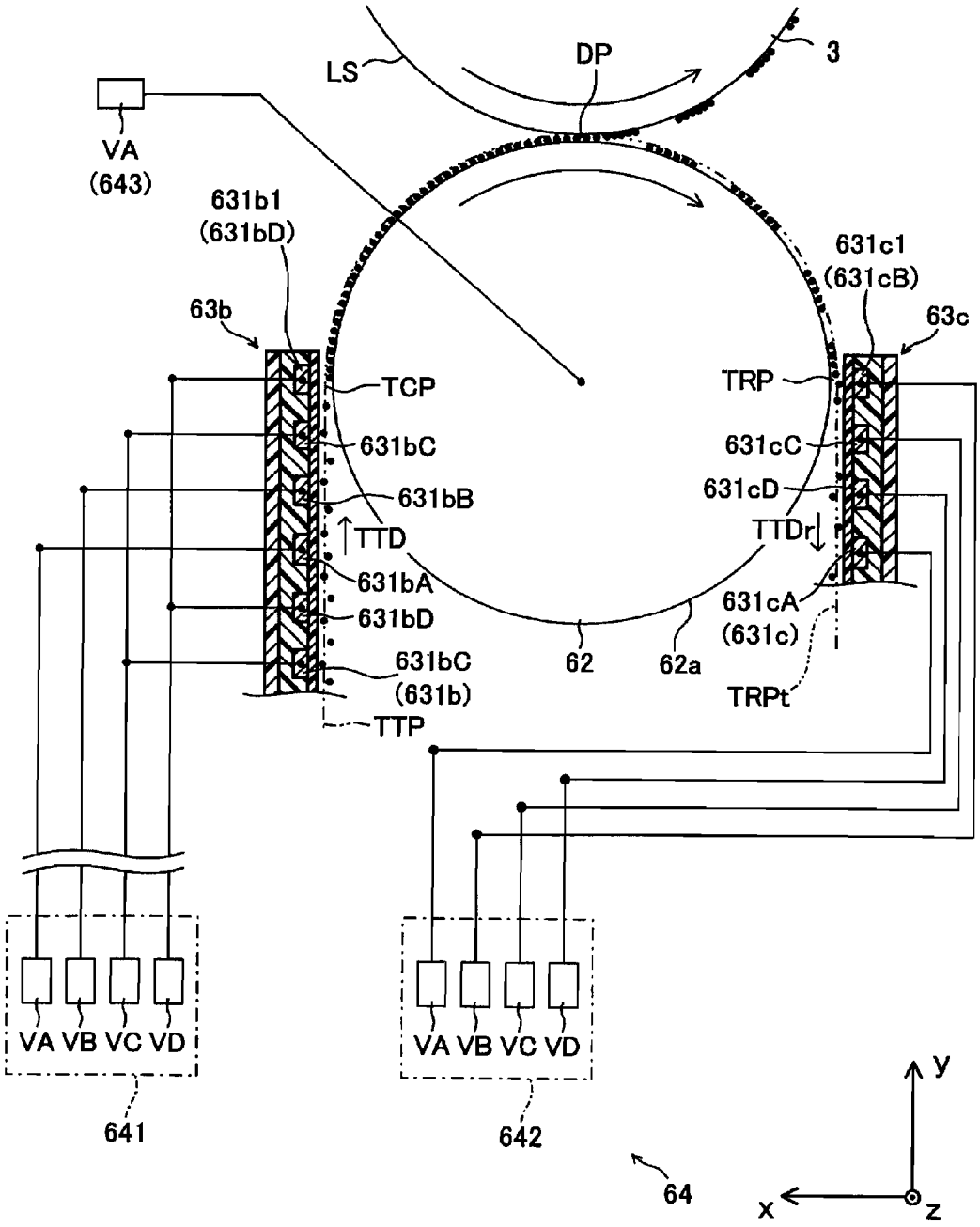
FIG. 13 is a side cross section illustrating a main portion of the toner supply unit shown in FIG. 11.

Hereafter, a main configuration around the toner catching position and the toner recovering position is explained in detail with reference to FIG. 13. In FIG. 13, the toner box 61 is omitted for the sake of simplicity.

As shown in FIG. 13, the supply substrate 63*b* and the development roller 62 are located such that a most downstream supply electrode 631*b*1 (which is located at a most downstream one of the plurality of supply electrodes 631*b* provided on the supply substrate 63*b* along the toner transport path TTP) is positioned to be closest to the toner holding surface 62*a*. That is, the most downstream supply electrode 631*b*1 is located at the position corresponding to the toner catching position TCP at which the supply substrate 63*b* and the toner holding surface 62*a* of the development roller 62 are closest to each other.

As shown in FIG. 13, the supply electrodes 631*b*A, 631*b*B, 631*b*C, 631*b*A are arranged along the toner transport direction TTD on the supply substrate 63*b*. In this case, the supply substrate 631*b*X means the supply electrode 631*b* connected to the power supply circuit VX (where X denotes one of A, B, C and D), which also apply to the notation of the collecting electrodes 631*c*A, 631*c*B, 631*c*C, 631*c* D and 631*c*A . . . .

To the most downstream supply electrode 631*b*1, the voltage having the phase which is delayed by one phase relative to the phase of the voltage applied to the neighboring supply electrode 631*b* located an immediately upstream position of the most downstream supply electrode 631*b*. That is, in this embodiment, the supply electrode 631*b*C adjacent to the most downstream supply electrode 631*b*1 on the upstream side in the toner transport direction TTD is connected to the power supply circuit VC. Further, the most downstream supply electrode 631*b*1 adjacent to the above described supply electrode 631*b*C is connected to the power supply circuit VD.

In this embodiment, to the development roller 62, the voltage which is delayed by one phase relative to the most downstream supply electrode 631*b*1 is applied. That is, the development roller 62 is connected to the power supply circuit VA.

Furthermore, to a most upstream collecting electrode 631*c*1 (which is a most upstream one of the plurality of collecting electrodes 631*c* arranged in the toner transport direction TTDr on the collecting substrate 63*c*), the voltage which is delayed by one phase relative to the phase of the voltage applied to the development roller 62 is applied. That is, in this embodiment, the most upstream collecting electrode 631*c*1 is connected to the power supply circuit VB.

The most upstream collecting electrode 631*c*1 is located at the position corresponding to the toner recovering position TRP at which the collecting substrate 63*c* is closest to the toner holding surface 62*a* of the development roller 62. On the downstream side of the most upstream collecting electrode 631*c*1 in the toner transport direction TTDr, the collecting electrodes 631*c*C, 631*c*D, 631*c*A . . . are arranged in this order in the toner transport direction TTDr.

In this embodiment, the voltage application unit 64 includes a carrying power supply circuit 641, a collecting power supply circuit 642 and a development bias power supply circuit 643. The carrying power supply circuit 641 is connected to the bottom carrying substrate 63*a* and the supply substrate 63*b*. The collecting power supply circuit 642 is connected to the collecting substrate 63*c*. the development bias power supply circuit 643 is connected to the development roller 62.

The carrying power supply circuit 641 outputs a carrying bias generated by combining an alternating bias (a multiphase alternating voltage component) of an amplitude of 600V with a D.C. bias (a D.C. voltage component) of 700V. The collecting power supply circuit 642 outputs a collection bias generated by combining an alternating bias (a multiphase alternating voltage component) of an amplitude of 600V with a D.C. bias (a D.C. voltage component) of 300V. The development bias power supply circuit 643 outputs an development bias generated by combining an alternating bias (a multiphase alternating voltage component) of an amplitude of 600V with a D.C. bias (a D.C. voltage component) of 500V.

That is, the voltage application unit 64 is configured to apply, to the supply electrodes 631*b*, the development roller 62 and the collecting electrodes 631*c*, the voltages on which the multiphase alternating voltage components which are synchronized with each other and the D.C. components for moving the toner T charged to have a predetermined polarity from the supply substrate 631*b* to the development roller 62 and moving the toner T from the development roller 62 to the collecting electrodes 631*c* are combined. In other words, the voltage application unit 64 is configured to apply, to the supply electrodes 631*b*, the development roller 62 and the collecting electrodes 631*c*, the voltages on which the synchronized alternating voltage components and the D.C. voltage components for setting the average potential of the development roller 62 to fall between the average potential of the supply electrodes 631*b* and the average potential of the collecting electrodes 631*c* are combined.

The voltage application unit 64 applies, to the supply electrodes 631*b* and the development roller 62, the voltage including the multiphase alternating voltage component whose number of phases is k (k=4 in this embodiment) so that the phase of the voltage applied to the development roller 62 and the phase of the voltage applied to the supply electrode 631*b* which is shifted by (k−1) electrodes to the upstream side in the toner transport direction TTD from the most downstream supply electrode 631*b*1 (which is nearest to the development roller 62) are in phase with respect to each other.

The voltage application unit 64 applies, to the collecting electrodes 631*c* and the development roller 62, the voltage including the multiphase alternating voltage component whose number of phases is k (k=4 in this embodiment) so that the phase of the voltage applied to the development roller 62 and the phase of the voltage applied to the collecting electrode 631*c* which is shifted by (k−1) electrodes to the downstream side in the toner transport direction TTDr from the most upstream collecting electrode 631*c*1 (which is nearest to the development roller 62) are in phase with respect to each other.

Referring now to FIGS. 11 and 12, the toner T stored in the toner box 61 charges, for example, by contact and friction with respect to the bottom overcoating 634*a* of the bottom carrying substrate 63*a*. The charged toner T which contacts or is situated closely to the bottom overcoating 634*a* of the bottom carrying substrate 63*a* is carried in the toner transport direction TTD by the electric field generated by the voltage applied to the bottom carrying substrate 631*a*, and is passed to the supply substrate 63*b*.

In this embodiment, the downstream end portion of the bottom carrying substrate 63*a* along the toner transport direction TTD (i.e., a connection part of the bottom carrying substrate 63*a* with respect to the supply substrate 63*b*) is formed to be a curved surface. Consequently, it becomes possible to smoothly pass the toner T from the bottom carrying substrate 63*a* to the lower end portion of the supply substrate 63*b*.

The supply substrate 63*b* carries upward the toner T which has been passed at the lower end portion thereof from the bottom carrying substrate 63*a*. Since the vertical overcoating 634*b* of the supply substrate 63*b* has the lower degree of effect of further charging positively the toner T than that of the bottom overcoating 634*a* of the bottom carrying substrate 63*a*, it becomes possible to prevent the charged state of the toner T being carried along the supply substrate 63*b* from being altered.

It should be noted that toner not properly charged (e.g., toner charged negatively or non-charged toner) has been mixed into the toner T passed from the bottom carrying substrate 63*a*. However, when the toner T is carried upward in the vertical direction along the supply substrate 63*b* to the toner catching position TCP or when the positively charged toner T is held on the development roller 62 at the toner catching position TCP through the electric field formed between the supply substrate 63*b* and the development roller 62, the toner not properly charged deviates from the toner transport path TTP and then falls downward from the supply substrate 63*b*.

With this configuration, only the toner T in a suitably charged state can be selectively carried to the toner catching position TCP. That is, on the supply substrate 63*b*, the toner not properly charged is separated from the toner T suitably charged. The toner which has fallen downward from the supply substrate 63*b* is circulated to the toner reservoir part 61*a*, and then is carried again upward to the toner catching portion TCP along the supply substrate 63*b*.

As described above, the positively charged toner T is carried to the toner catching position TCP along the supply substrate 63*b*. As shown in FIGS. 4 and 13, the multiphase alternating voltages which are in synchronization with the voltage applied to the supply electrodes 631*b* is applied to the development roller 62. More specifically, to the development roller 62 connected o the power supply circuit VA, the voltage which is delayed by one phase relative to the voltage of the most downstream supply electrode 631*b*1 is applied.

In this case, the electric field which is equivalent to the traveling electric field carrying the toner T on the supply substrate 63*b* in the toner transport direction TTD is formed at the toner catching position TCP between the most downstream supply electrode 631*b*1 and the toner holding surface 62*a* of the development roller 62.

It should be noted that between the supply electrodes 631*b* and the development roller 62, a relatively low D.C. bias voltage of approximately 200V is applied. Therefore, the voltage applied to the toner catching position TCP does not include an excessively high D.C. bias voltage for moving the positively charged toner to the development roller 62. As a result, the toner T smoothly moves to the development roller 62 through the electric field generated at the toner catching position TCP, and is suitably held on the toner holding surface 62*a*. More specifically, the toner T which has held on the toner holding surface 62*a* is prevented from returning to the carrying substrate (i.e., the supply substrate 63*b*). Furthermore, the toner T (which may be toner not properly charged) being carried on the carrying substrate without being synchronized with the carrying bias is prevented from being supplied to the development roller 62, and thereby the toner T not properly charged is prevented from being held on the toner holding surface 62*a*.

The positively charged toner T is thus supplied to the development position DP. In the vicinity of the development position DP, the electrostatic latent image formed on the electrostatic latent image holding surface LS is developed with the toner T. That is, the toner T adheres to a part of the electrostatic latent image holding surface LS where positive charges of the electrostatic latent image are removed. As a result, an image formed by the toner T (hereafter, referred to as a toner image) is held on the electrostatic latent image holding surface LS.

The toner T which is held on the toner holding surface 62*a* and has passed the development position DP (i.e., the toner T which has not consumed at the development position DP) moves to the toner recovering position TRP. As shown in FIGS. 4 and 13, to the development roller 62, the multiphase alternating voltage which is in synchronization with the voltage applied to the collecting electrodes 631*c* is applied. More specifically, to the development roller 62 connected to the power supply circuit VB, the voltage which precedes by one phase relative to the voltage applied to the most upstream collecting electrode 631*c*1 is applied.

In this case, the electric field which is equivalent to the traveling electric field for carrying the toner T on the collecting substrate 63*c* in the toner transport direction TTD is formed at the toner recovering position TRP between the most upstream collecting electrode 631*c*1 and the toner holding surface 62*a* of the development roller 62.

It should be noted that between the development roller 62 and the collecting electrodes 631*c* (the most upstream collecting electrode 631*c*1), a relatively low D.C. bias voltage of approximately 200V is applied. Therefore, the voltage applied to the toner recovering position TRP does not include a relatively large D.C. bias for moving, toward the collecting substrate 62*c*, the toner T adhered firmly to the toner holding surface 62*a* through an image force or Vander Waals' force.

Therefore, the toner T is smoothly moved from the development roller 62 to the collecting substrate 63*c* through the traveling electric field generated at the toner recovering position TRP. That is, the toner T is collected by the collecting substrate 63*c* from the toner holding surface 62*a* at the toner recovering position TRP. More specifically, the toner T which has collected from the toner holding surface 62*a* is prevented from returning to the toner holding surface 62*a* of the development roller 62. Then, the collected toner T is suitably carried in the toner transport direction TTDr without being pressed against the collecting substrate 63*c* by the above described relatively larger D.C. bias.

In addition, the voltage applied to the development roller 62 serves as a development bias for causing a so-called jumping phenomenon at the development position DP. Therefore, the development bias can be achieved with a simple structure.

At the lower end portion of the collecting substrate 63*c*, the toner T is carried downwardly in the vertical direction. In this case, the inertia having the same direction as that of gravity acts on the toner T. Further, in a downward portion with respect to the lower end of the collecting substrate 63*c*, the toner T falls toward the toner reservoir part 61*a* by the effect of the gravity and the inertia having the same direction as that of the gravity. Therefore, the toner T suitably circulates to the toner reservoir part 61*a* even when the collecting substrate 63*c* is not formed to reach the toner reservoir part 61*a*.

Hereafter, a first variation of the toner supply unit according to the second embodiment (a toner supply unit 6E) is explained with reference to FIGS. 14 and 15. It should be noted that in FIGS. 14 and 15, to elements which are substantially the same as those show in the above described embodiment, the same reference numbers are assigned, and explanations thereof will not be repeated for the sake of simplicity.

Figure 14:
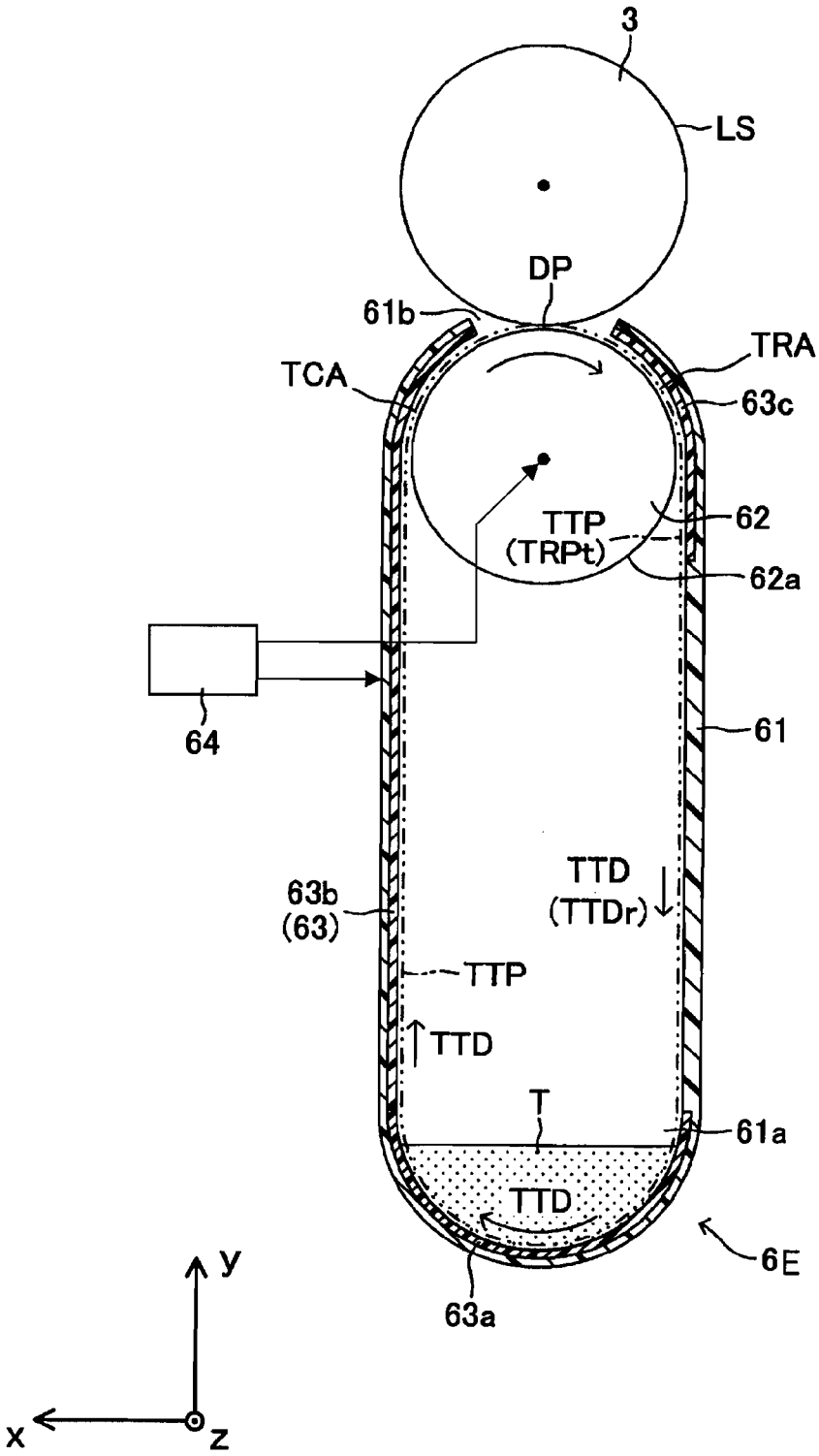
FIG. 14 is an enlarged side cross section illustrating a toner supply unit according to a first variation of the second embodiment.
Figure 15:
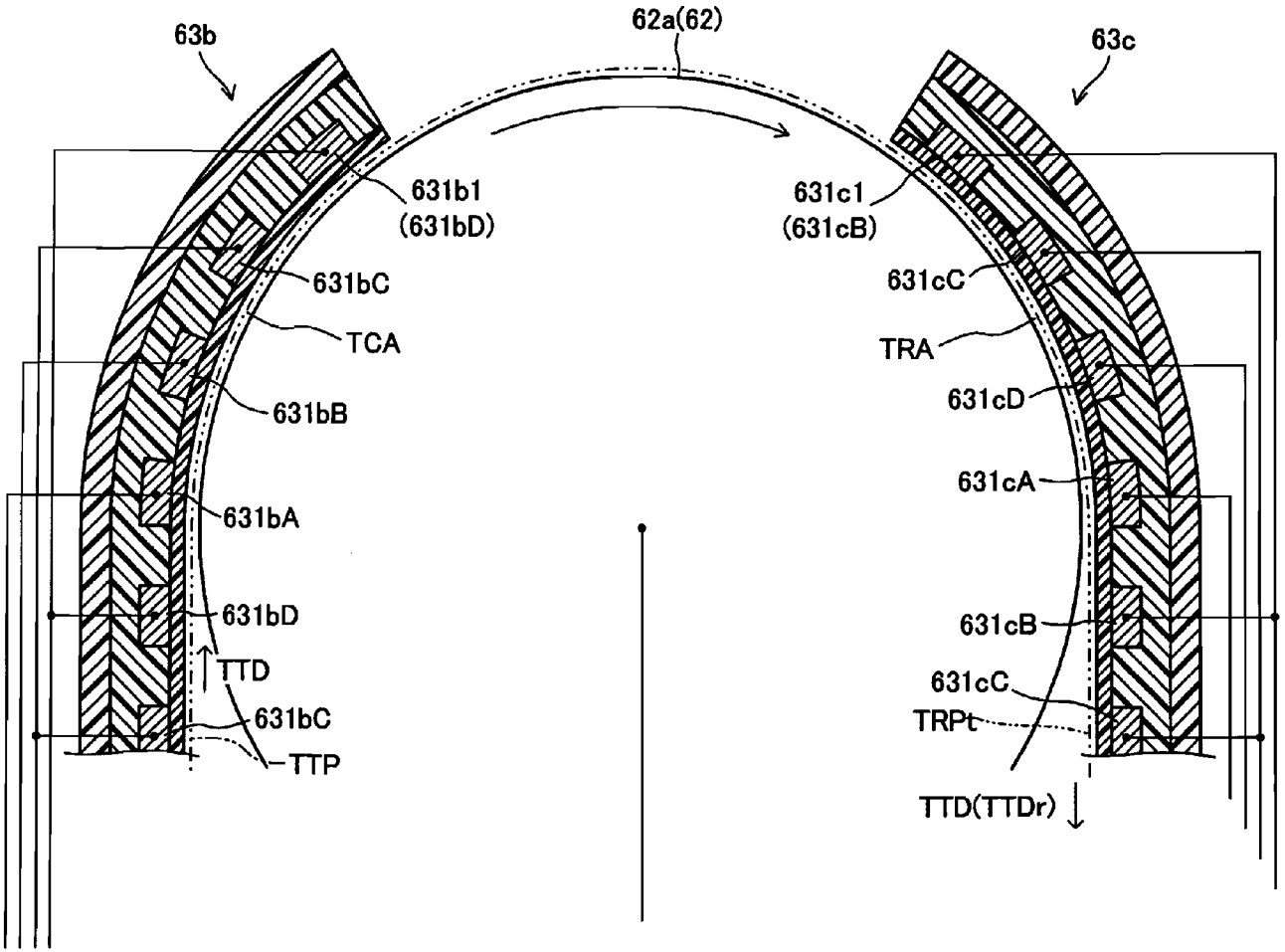
FIG. 15 is an enlarged side cross section of a carrying substrate provided in the toner supply unit shown in FIG. 14.

As shown in FIGS. 14 and 15, each of the upper end portion of the supply substrate 63*b* and the collecting substrate 63*c* is formed to be a curved portion which is curved along the cylindrical surface of the development roller 62.

In this variation, the top end of the supply substrate 63*b* is provided to reach the position higher than the center of the development roller 62. That is, the top end of the supply substrate 63*b* is formed to reach the opening 61*b*. The upper end portion is formed to be a recessed curved portion so as to face with the cylindrical toner holding surface 62*a* of the development roller 62 via a constant interval (e.g., approximately 300 μm).

In this variation, the upper end portion of the collecting substrate 63*c* is formed to be a recessed portion so as to face with the development roller 62 via a constant interval (e.g., approximately 300 μm which is narrower than the gap formed at the development position DP between the photosensitive drum 3 and the development roller 62. Furthermore, the lower end portion of the collecting substrate 63*c* is formed to carry downward the toner T in the vertical direction.

As shown in FIG. 15, in contrast to the configuration of the above described embodiment where only the most downstream supply electrode 631*b*1 is located to be closest to the toner holding surface 62*a*, in the first variation a plurality of supply electrodes 631*b* including the most downstream supply electrode 631*b*1 are provided at a toner catching area TCA where the upper end portion of the supply substrate 63*b* faces the toner holding surface 62*a*.

In addition, in contrast to the configuration of the above described embodiment where only the most upstream collecting electrode 631*c*1 is located to be closest to the toner holding surface 62*a*, in the first variation a plurality of collecting electrodes 631*c* including the most upstream collecting electrode 631*c*1 are provided at a toner recovering area TRA where the upper end portion of the collecting substrate 63*c* faces the toner holding surface 62*a*.

In the first variation, the frequency of the output voltage of the carrying power supply circuit 64 is defined such that the carrying speed of the toner T in the toner transport direction TTD by the carrying substrate 63 (i.e., the supply substrate 63*b* and the collecting substrate 63*c*) is set to be larger than or equal to a value which is twice as large as the moving speed of the toner holding surface 62*a* by rotation of the development roller 62. As a result, the toner T can be suitably held on the toner holding surface 62*a*, and the toner T can be suitably collected from the toner holding surface 62*a*.

Figure 16:
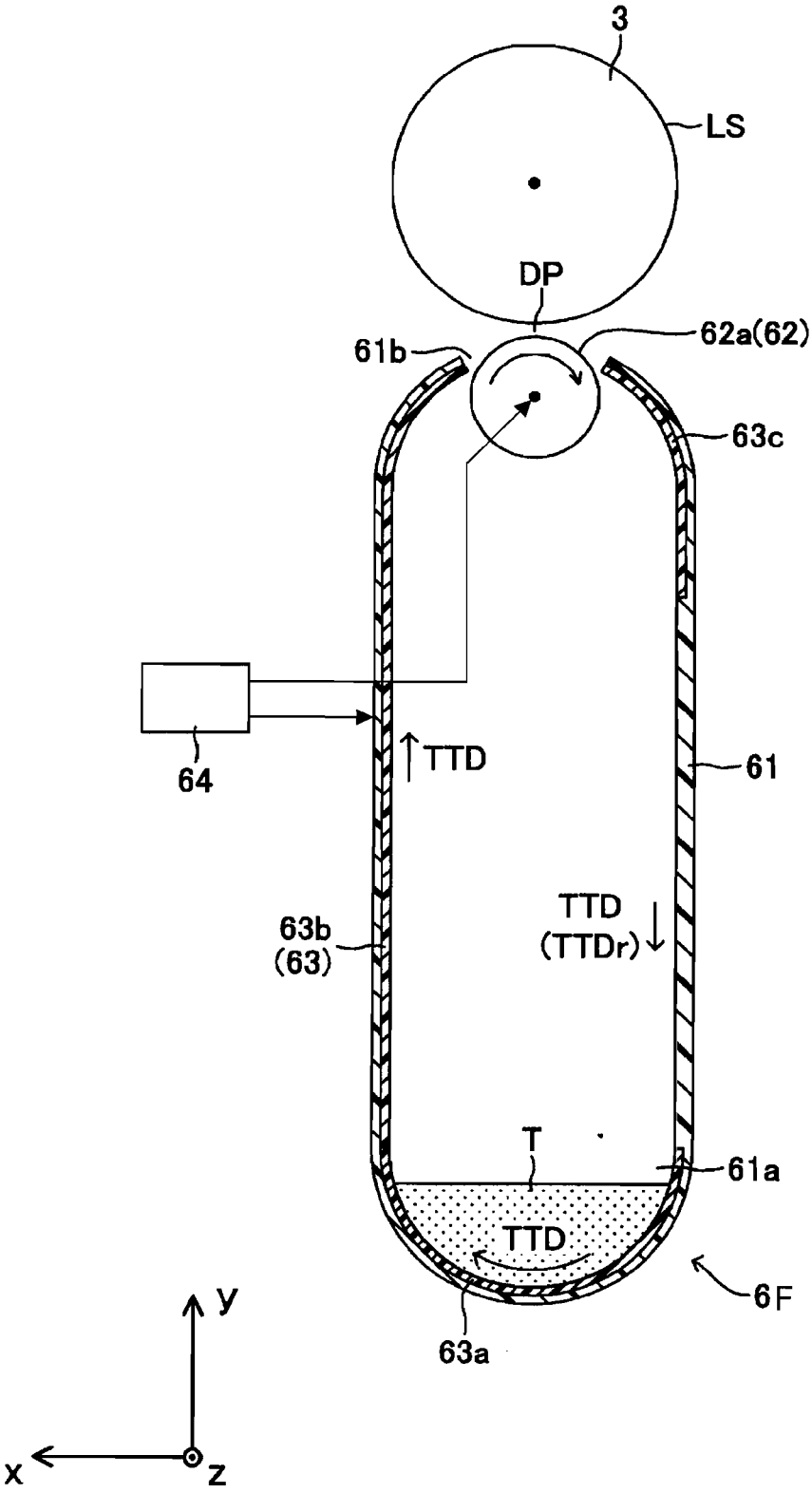
FIG. 16 is an enlarged side cross section illustrating a toner supply unit according to a second variation of the second embodiment.

Hereafter, a second variation of the toner supply unit according to the second embodiment (a toner supply unit 6F) is explained with reference to FIGS. 16 and 17. It should be noted that in FIGS. 16 and 17, to elements which are substantially the same as those show in the above described embodiment, the same reference numbers are assigned, and explanations thereof will not be repeated for the sake of simplicity.

As in the case of the above described embodiment, in the second variation, only the most downstream supply electrode 631*b*1 of the plurality of supply electrodes 631*b* is located to be closest to the toner holding surface 62*a*. Further, only the most upstream supply electrode 631*c*1 of the plurality of collecting electrodes 631*c* is located to be closest to the toner holding surface 62*a*.

In this configuration, the toner T can be suitably held on the toner holding surface 62*a*, and the toner T can be suitably collected from the toner holding surface 62*a*.

Figure 17:
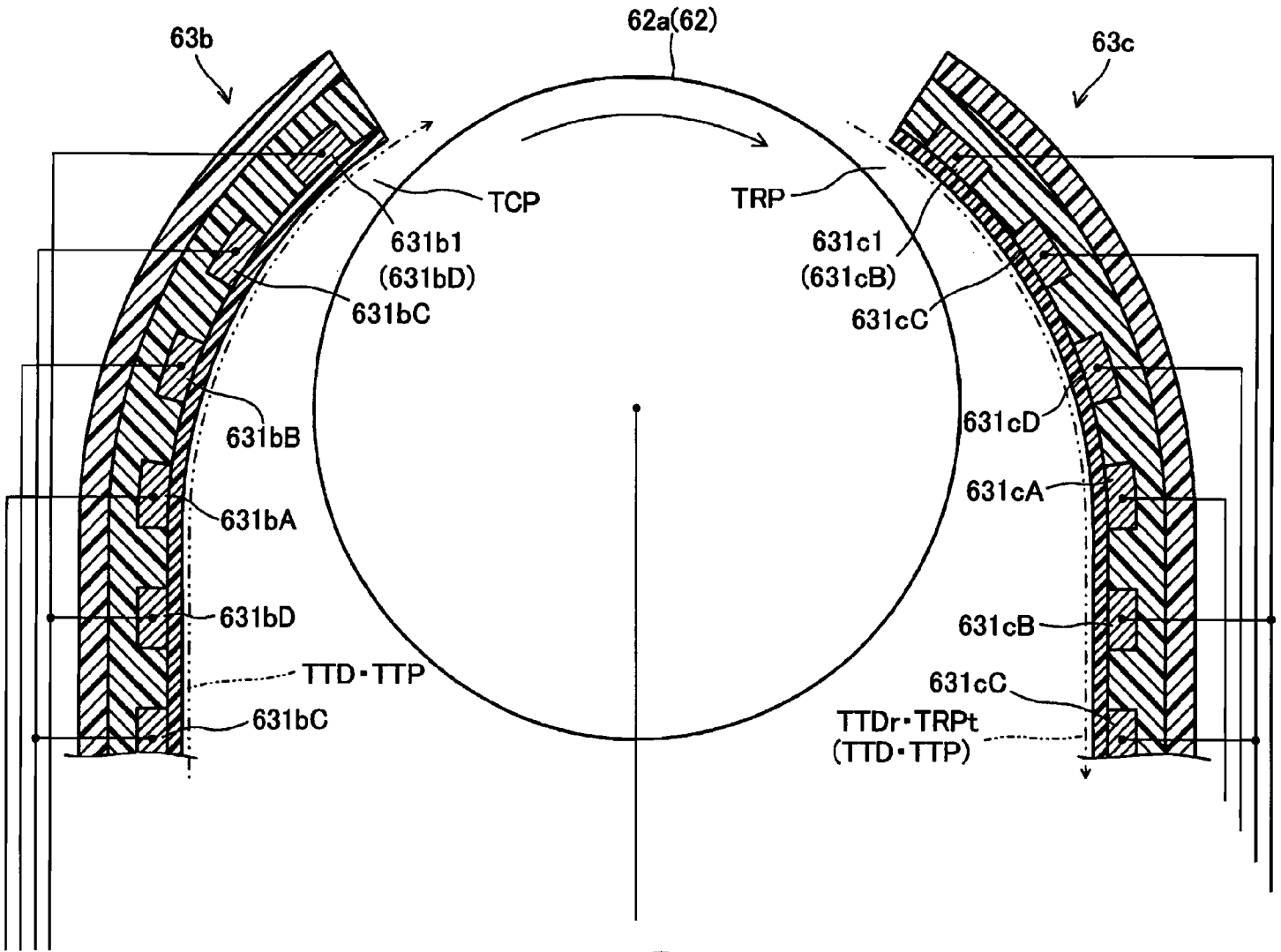
FIG. 17 is an enlarged side cross section of a carrying substrate provided in the toner supply unit shown in FIG. 16.

In particular, as shown in FIG. 17, a part of the toner holding surface 62*a* at which the toner T is supplied from the most downstream supply electrode 631*b*1 to the toner holding surface 62*a* is formed to be along the toner transport direction TTD defined at the position corresponding to the most downstream supply electrode 631*b*1 on the toner transport path TTP. In other words, the part of the toner holding surface 62*a* at which the toner T is supplied from the most downstream supply electrode 631*b*1 to the toner holding surface 62*a* is formed to be a tangential direction of the toner transport path TTP defined at the position corresponding to the most downstream supply electrode 631*b*1. As a result, the toner T can be suitably moved from the supply electrode 63*b* to the development roller 62, and the toner T can be suitably held on the toner holding surface 62*a*.

As shown in FIG. 17, a part of the toner holding surface 62*a* at which the toner T is collected by the most upstream supply electrode 631*c*1 is formed to be along the toner transport direction TTDr defined at the position corresponding to the most upstream supply electrode 631*c*1 on the toner recovering path TRPt (i.e., a part of the toner holding surface 62*a* at which the toner T is collected by the most upstream supply electrode 631*c*1 is formed to be in a direction tangential to the toner recovering path TRPt at the position). In other words, the part of the toner holding surface 62*a* at which the toner T is collected by the most upstream supply electrode 631*c*1 is formed to be a tangential direction of the toner transport path TTP defined at the position corresponding to the most upstream supply electrode 631*c*1. With this configuration, the toner can be smoothly moved from the development roller 62 to the collecting substrate 63*c*. As a result, the toner T can be suitably collected from the toner holding surface 62*a* to the collecting substrate 63*c*, and the toner T can be suitably carried in the toner transport direction TTDr.

Figure 18:
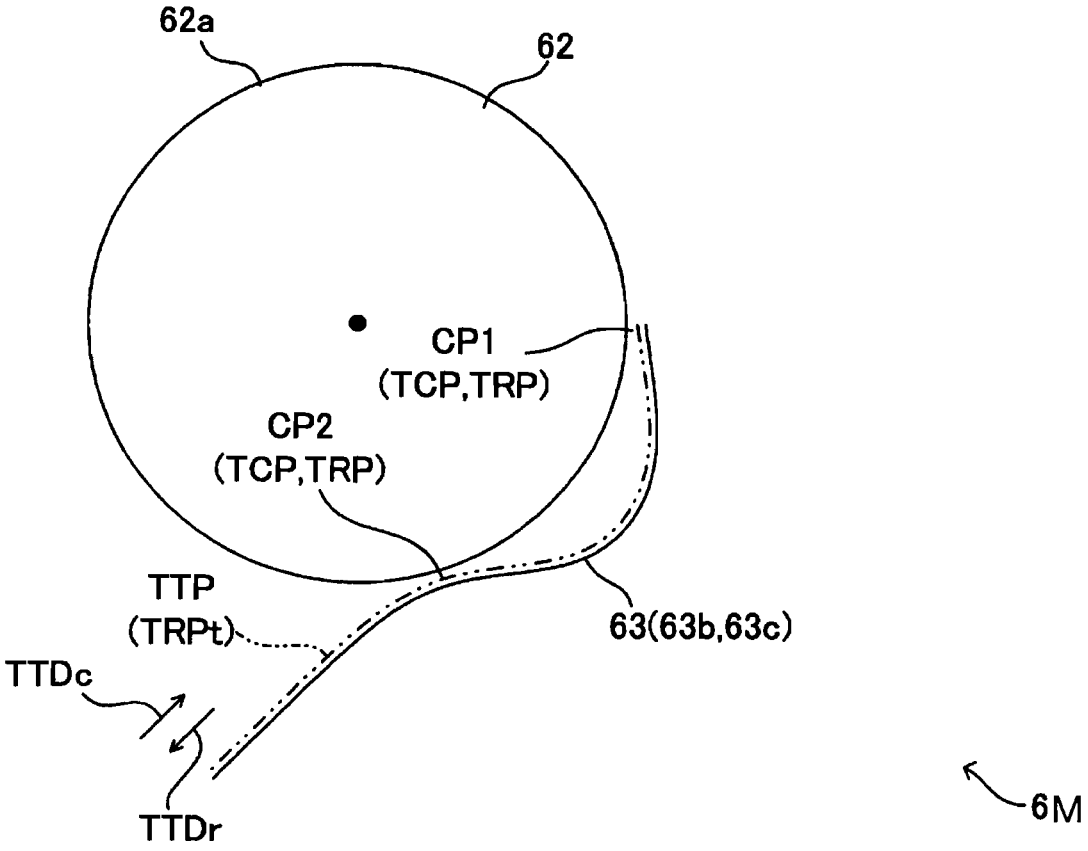
FIG. 18 is a side cross section illustrating a configuration of a toner supply unit according to a third variation of the second embodiment.

Hereafter, a third variation of the toner supply unit according to the second embodiment (a toner supply unit 6M) is explained with reference to FIG. 18. It should be noted that in FIG. 18, to elements which are substantially the same as those show in the above described embodiment, the same reference numbers are assigned, and explanations thereof will not be repeated for the sake of simplicity. As shown in FIG. 18, the toner supply unit according to the third example is formed such that the carrying substrate 63 has two positions closely located with respect to the toner holding surface 62*a*.

That is, the supply substrate 63*b* and the development roller 62 are located so that a plurality of toner catching positions TCP are provided. With this configuration, the toner T can be holed on the toner holding surface 62*a* more suitably.

In FIG. 18, a toner transport direction TTDc represents a toner transport direction defined if the carrying substrate 63 is the supply substrate 63*b*. In this case, the toner supply unit according to the third variation is configured to satisfy the following condition:

$$L=n\cdot k\cdot p=f\{m+(1/2)\}/f/v \quad (1)$$

where L represents a distance between two neighboring toner catching positions TCP (i.e., a distance between the first facing position CP1 and the second facing position CP2) along the toner transport direction TTDc, v represents a moving speed of the toner holding surface 62*a* by rotation of the development roller 62, f represents a frequency of the multiphase alternating voltage in a traveling waveform applied to the supply electrodes 631*b* and the development roller 62, k represents the number of phase of the multiphase alternating voltage in a traveling waveform applied to the supply electrodes 631*b* and the development roller 62, p represents a pitch of the plurality of supply electrodes 631*b*, and m and n are integers.

More specifically, when the multiphase alternating voltage is the four-phase, and the moving speed v of the toner holding surface 62*a* and the toner carrying speed of the toner by the supply substrate 63*b* in the toner transport direction TTDc are equal to each other, the voltage which is shifted by two phases relative to the phase of the voltage applied to the supply electrode 631*b* at the first facing position CP1 is applied to the supply electrode 631*b* at the second facing position CP2.

With this configuration, the toner T can be suitably moved, at the first facing position CP1, to a position on the toner holding surface 62*a* to which the toner T has not been moved from the carrying substrate 63 at the second facing position CP2. As a result, the toner T can be held on the toner holding surface 62*a* more suitably.

Alternatively, as shown in FIG. 18, the collecting substrate 63*c* and the development roller 64 may be arranged such that more than one toner recovering position TRP are provided. With this configuration, the toner can be collected from the toner holding surface 62*a* more stably. In FIG. 19, the toner transport direction TTDr represents a toner transport direction defined when the carrying substrate 63 is the collecting substrate 63*c*. In this case, the toner supply unit according to the third variation is configured to satisfy the following condition:

$$L=n\cdot k\cdot p=[\{m+(1/2)\}\cdot f]/v \quad (2)$$

where L represents a distance between neighboring toner recovering positions TRP (i.e., a distance between the first facing position CP1 and the second facing position CP2) along the toner transport direction TTDr, v represents a moving speed of the toner holding surface 62*a* by rotation of the development roller 62, f represents a frequency of the multiphase alternating voltage in a traveling waveform applied to the collecting electrodes 631*c* and the development roller 62, k represents the number of phase of the multiphase alternating voltage in a traveling waveform applied to the collecting electrodes 631*c* and the development roller 62, p represents a pitch of the plurality of collecting electrodes 631*c*, and m and n are integers.

More specifically, when the multiphase alternating voltage is the four-phase, and the moving speed v of the toner holding surface 62*a* and the toner carrying speed of the toner by the collecting substrate 63*c* in the toner transport direction TTDr are equal to each other, the voltage which is shifted by two phases relative to the phase of the voltage applied to the supply electrode 631*c* at the first facing position CP 1 is applied to the supply electrode 631*c* at the second facing position CP2.

With this configuration, the toner T which has not been collected at the first facing position CP and remains on the toner holding surface 62*a* can be suitably collected from the toner holding surface 62*a* at the second facing position CP2. As a result, the toner remaining on the toner holding surface 62*a* can be suitably collected, and therefore it becomes possible to suitably prevent a ghost image from occurring on the formed image.

Although the present invention has been described in considerable detail with reference to certain preferred embodiments thereof, other embodiments are possible.

(1) Application of the above described embodiment is not limited to a monochrome laser printer. For example, the above described embodiment may be applied to various types of electrophotographic printers, such as a color laser printer and a monochrome or color copying device. In such a case, the shape of a photosensitive body is not limited to the drum shape described in the embodiment. For example, a flat plate type or endless belt type photosensitive body may be employed. Various types of light sources for exposing other than the laser scanning unit may be employed. For example, LED, EL (electroluminescence) device or a fluorescent element may be employed. In this case, the main scanning direction is defined as a arrangement direction in which light emitting elements (e.g., LEDs) are arranged.

The above described embodiment may also be applied to an image forming device which is not the electrophotographic type image forming device. For example, the above described embodiment may be applied to a toner jet type device, an ion flow type device and a multi-stylus type device which do not use a photosensitive body.

(2) The photosensitive drum 3 and the development roller 62 may be located to contact with each other.

(3) The configuration of the carrying substrate 63 is not limited to that shown in the above described embodiment. For example, the electrode overcoating 634 may be omitted. In this case, the material of the electrode coating 633 may be selected as in the case of the electrode coating 634. Alternatively, by burying the carrying electrodes 631 in the electrode support film 632, the electrode coating 633 and the electrode overcoating 634 can be omitted.

The supply substrate 63*b* may be formed to stand substantially in the vertical direction. That is, the supply substrate 63*b* may be inclined to some extent. Similarly, the collecting substrate 63*c* may be inclined to some extent.

The central part of the bottom carrying substrate 63*a* may be formed to be a flat shape. That is, only the connection part of the bottom carrying substrate 63*a* connected to the lower end of the supply substrate 63*b* may be formed as the curved surface part. The bottom carrying substrate 63*a* may be formed integrally with the supply substrate 63*b* or may be formed separately from the supply substrate 63*b*.

The termination of the collecting substrate 63*c* in the toner transport direction TTD may be connected to the bottom carrying substrate 63*a*. In this case, the bottom carrying substrate 63*a* may be integrally formed with the collecting substrate 63*c* or may be formed separately from the collecting substrate 63*c*.

The bottom carrying substrate 63*b*, the supply substrate 63*b* and the collecting substrate 63*c* may be formed integrally with the toner box 61. For example, the carrying substrate 63 having an integrated structure of the bottom carrying substrate 63*a*, the supply substrate 63*b* and the collecting substrate may formed of a solid substrate which is bent to have a shape of a letter "U" when viewed as a side cross section.

(4) The waveforms of the output voltages of the power supply circuits VA to VD are not limited to the rectangular shape shown in FIG. 4. For example, sine waveforms or triangular waveforms may be employed as output voltages of the power supply circuits VA to VD.

In the above described embodiment, four power supply circuits VA to VD are provided, and phases of the output voltages of the power supply circuits VA to VD are shift by 90° with respect to each other. However, the embodiment is not limited to such a structure. For example, in another embodiment, three power supply circuits may be employed, and in this case phases of output voltages of the three power supply circuits may shift by 120° with respect to each other.

What is claimed is:

1. A developer supply device, comprising:

a developer holding body having a cylindrical circumferential surface and a rotation axis extending in a main scanning direction so that the developer holding body is rotated about the rotation axis, the developer holding body being placed to face a supply target at a developer supply position;

a carrying substrate that has a plurality of electrodes arranged along a direction intersecting with the main scanning direction and that carries a developer in a developer transport direction through a traveling electric field generated by application of a multiphase alternating voltage to the plurality of electrodes, the carrying substrate being located such that an end of the carrying substrate in the developer transport direction is positioned to face the developer holding body; and a voltage application unit configured to apply, to the plurality of electrodes and the developer holding body, the multiphase alternating voltage having alternating components synchronizing with each other.

2. The developer supply device according to claim 1, wherein:

the carrying substrate is formed to be a supply substrate configured to carry the developer to the developer holding body in the developer transport direction; and the supply substrate is arranged such that a downstream end thereof in the developer transport direction faces the developer holding body, at a developer holding position defined on an upstream side of the developer supply position in a moving direction of the cylindrical circumferential surface of the developer holding body by rotation of the developer holding body.

3. The developer supply device according to claim 2, wherein the supply substrate and the developer holding body are arranged such that a most downstream electrode of the plurality of electrodes defined in the developer transport direction is closest to the developer holding body.

4. The developer supply device according to claim 3, wherein a phase of the voltage applied to the developer holding body is delayed by one phase relative to a phase of the multiphase alternating voltage applied to the most downstream electrode.

5. The developer supply device according to claim 2, wherein the supply substrate is arranged such that the supply substrate closely faces the developer holding body at a plurality of developer holding positions.

6. The developer supply device according to claim 5, wherein the developer supply device is configured to satisfy a condition:

$$L=n\cdot k\cdot p=[\{m+(1/2)\}\cdot f]/v$$

where L represents a distance between the neighboring developer holding positions along the developer transport direction, v represents a moving speed of the cylindrical circumferential surface of the developer holding body by rotation of the developer holding body, f represents a frequency of the multiphase alternating component applied to the plurality of electrodes and the alternating component applied to the developer holding body, k represents a number of phases of the multiphase alternating voltage, p represents a pitch of the plurality of electrodes, and m and n are integers.

7. The developer supply device according to claim 1, wherein:

the carrying substrate is formed to be a collecting substrate configured to collect the developer from the developer holding body and to carry the developer in the developer transport direction; and the collecting substrate is arranged such that an upstream end thereof in the developer transport direction faces the developer holding body, at a developer recovering position defined on a downstream side of the developer supply position in a moving direction of the cylindrical circumferential surface of the developer holding body by rotation of the developer holding body.

8. The developer supply device according to claim 7, wherein the collecting substrate and the developer holding body are arranged such that a most upstream electrode of the plurality of electrodes defined in the developer transport direction is closest to the developer holding body.

9. The developer supply device according to claim 8, wherein a phase of the voltage applied to the developer holding body precedes by one phase relative to a phase of the multiphase alternating voltage applied to the most upstream electrode.

10. The developer supply device according to claim 7, wherein the collecting substrate is arranged such that the collecting substrate closely faces the developer holding body at a plurality of developer recovering positions.

11. The developer supply device according to claim 10, wherein the developer supply device is configured to satisfy a condition:

$$L=n\cdot k\cdot p=[\{m+(1/2)\}\cdot f]/v$$

where L represents a distance between the neighboring developer recovering positions along the developer transport direction, v represents a moving speed of the cylindrical circumferential surface of the developer holding body by rotation of the developer holding body, f represents a frequency of the multiphase alternating component applied to the plurality of electrodes and the alternating component applied to the developer holding body, k represents a number of phases of the multiphase alternating voltage, p represents a pitch of the plurality of electrodes, and m and n are integers.

12. The developer supply device according to claim 1, wherein a carrying speed of the developer in the developer transport direction by the carrying substrate is larger than or equal to a two-fold value of a moving speed of the cylindrical circumferential surface of the developer holding body.

13. The developer supply device according to claim 1, wherein the multiphase alternating voltage is applied to the developer holding body and the plurality of electrodes such that a potential of the developer holding body is equal to at least one of the plurality of electrodes.

14. The developer supply device according to claim 1, wherein:

the carrying substrate is formed to be a supply substrate configured to carry the developer to the developer holding body in the developer transport direction, the supply substrate being arranged such that a downstream end thereof in the developer transport direction faces the developer holding body; and the multiphase alternating voltage applied to the developer holding body and the plurality of electrodes by the voltage application unit is combined with D.C. components defined such that the developer moves from the supply substrate to the developer holding body.

15. The developer supply device according to claim 14, wherein when the multiphase alternating voltage is k-phase, the multiphase alternating voltage is applied such that a phase of a voltage applied to an electrode of the plurality of electrodes positioned at (k−1)-th position counted, in the developer transport direction, from a most downstream electrode which is closest to the developer holding body of all of the electrodes is equal to a phase of a voltage applied to the developer holding body.

16. The developer supply device according to claim 14, further comprising a collecting substrate that has a plurality of collecting electrodes arranged in the developer transport direction, and that is arranged such that an upstream end thereof in the developer transport direction faces the developer holding body to collect the developer from the developer holding body and to carry the developer in the developer transport direction, wherein:

the voltage application unit is configured to apply, to the plurality of electrodes of the supply substrate, the developer holding body and the plurality of collecting electrodes of the collecting substrate, the multiphase alternating voltage having alternating components synchronizing with each other; and the multiphase alternating voltage applied to the plurality of electrodes of the supply substrate, the developer holding body and the plurality of collecting electrodes of the collecting substrate by the voltage application unit is combined with D.C. components defined such that an average potential of the developer holding body is set between an average potential of the plurality of electrodes of the supply substrate and an average potential of the plurality of collecting electrodes of the collecting substrate.

17. The developer supply device according to claim 16, wherein when the multiphase alternating voltage is k-phase, the multiphase alternating voltage is applied such that a phase of a voltage applied to an electrode of the plurality of collecting electrodes positioned at (k−1)-th position counted, in the developer transport direction, from a most upstream collecting electrode which is closest to the developer holding body of all of the plurality of collecting electrodes is equal to a phase of a voltage applied to the developer holding body.

* * * * *